US006928668B2

(12) United States Patent
Kuhn

(10) Patent No.: US 6,928,668 B2
(45) Date of Patent: Aug. 16, 2005

(54) DEVICE WITH TOILET CARE ACTION

(75) Inventor: Petrus Henricus A. N. Kuhn, Den Haag (NL)

(73) Assignee: Sara Lee/DE N.V., Utrecht (NL)

( * ) Notice: Subject to any disclaimer, the term of this patent is extended or adjusted under 35 U.S.C. 154(b) by 0 days.

(21) Appl. No.: 10/850,599

(22) Filed: May 19, 2004

(65) Prior Publication Data

US 2004/0244101 A1 Dec. 9, 2004

(30) Foreign Application Priority Data

Nov. 18, 2002 (NL) ..... PCT/NL02/00746

(51) Int. Cl.[7] ..... E03D 9/02
(52) U.S. Cl. ..... 4/231
(58) Field of Search ..... 4/231

(56) References Cited

U.S. PATENT DOCUMENTS 6,434,758 B2 * 8/2002 Camp et al. ..... 4/231
6,651,261 B1 * 11/2003 Leonard et al. ..... 4/231

FOREIGN PATENT DOCUMENTS

| | | |
|---|---|---|
| WO | 99/66139 | 12/1999 |
| WO | 01/02653 | 1/2001 |
| WO | 02/40792 | 5/2002 |

* cited by examiner

*Primary Examiner*—Charles E. Phillips
(74) *Attorney, Agent, or Firm*—Altera Law Group, LLC

(57) ABSTRACT

A device with a toilet care action, provided with a reservoir having at least one compartment for an active liquid, a liquid collecting element which, during use, is in a constant communication with the contents of the at least one compartment, and provided with fastening means for fastening the device to a toilet in such a manner that, in an operative condition of the device, the liquid collecting element is located in a path of toilet flushing water, the liquid collecting element comprising a plate which on a side facing the flushing water stream is provided with liquid collecting means, while the side of the plate facing away from the flushing water stream is also provided with liquid collecting means which are in communication with the liquid collecting means of the side facing the flushing water stream via capillary channels provided in the plate.

18 Claims, 23 Drawing Sheets

DEVICE WITH TOILET CARE ACTION

This invention relates to a device with a toilet care action, provided with a reservoir having at least one compartment for an active liquid, a liquid collecting element manufactured from a non-porous material which, during use, is constantly or periodically in communication with the contents of the at least one compartment, and provided with fastening means for fastening the device to the rim of a toilet bowl in such a manner that, in an operative condition of the device, the liquid collecting element is located in a path of toilet flushing water, the liquid collecting element having a side facing the flushing water stream and a side facing away from the flushing water stream, the side facing the flushing water stream being provided with liquid collecting means.

Such a device is known from the International patent application WO 99/66139 (S.C. Johnson & Son). The reservoir is there designed as a bottle which is detachably connected with a holder carrying the fastening means and the liquid collecting element. The liquid collecting element in this device is designed as a plate provided on the side facing the flushing water stream with grooves forming the liquid collecting means. The bottle of this device is provided with a single compartment. In the operative condition of the known device, the bottle is connected with the holder, and the holder is fastened to the rim of a toilet bowl by means of the fastening means. The liquid collecting means of the plate take up active liquid from the compartment. During flushing of the toilet bowl, flushing water flows over the side of the plate facing the flushing water stream, whereby active liquid is released to the flushing water. The released active liquid can clean the toilet bowl. Moreover, a part of the active liquid can evaporate to an environment to freshen the toilet room. After a flushing of the toilet bowl, the liquid collecting means of the plate are filled with a new amount of active liquid from the compartment.

It is a drawback of the known device that the regeneration of the liquid collecting means of the plate takes a considerable amount of time. Consequently, when the toilet is used intensively, the device is not capable of releasing sufficient active liquid during each toilet flushing for the purpose of cleaning and freshening the toilet.

Accordingly, the object of the invention is to provide a device with a toilet care action that eliminates the drawbacks of the known device while retaining the advantages thereof, at least a device in which the regeneration of the liquid collecting means proceeds relatively fast.

To this end, the device according to the invention is characterized in that the side of the liquid collecting element facing away from the flushing water stream is also provided with liquid collecting means which are in communication with the liquid collecting means of the side facing the flushing water stream via channels arranged in the liquid collecting element.

Surprisingly, it has been found that, as a result, the regeneration of the liquid collecting means proceeds relatively fast. Therefore, the toilet can be used again soon, while the liquid collecting means are sufficiently filled with active liquid to accomplish a proper toilet cleansing and freshening.

The operation of the device according to the invention is as follows. In the operative condition, the liquid collecting means of the side facing the flushing water stream take up active liquid, which liquid, via the channels in the liquid collecting element, also reaches the liquid collecting means of the side of the liquid collecting element facing away from the flushing water stream. After flushing of the toilet, the liquid collecting means of the side facing the flushing water stream are regenerated from the at least one compartment. The liquid collecting means of the side facing away from the flushing water stream can effect an additional regeneration of the liquid collecting means of the side facing the flushing water stream by returning active liquid thereto via the channels.

An additional advantage is that the liquid collecting means of the side facing away from the flushing water stream do not, during flushing of the toilet, hinder the release of active liquid by the liquid collecting means of the side facing the flushing water stream. Moreover, the liquid collecting means of the side facing away from the flushing water stream can cover a relatively large surface, so that these means can take up a relatively large amount of active liquid for the purpose of regeneration of the liquid collecting means of the side facing the flushing water stream. This provides the advantage that the liquid collecting means of the side facing away from the flushing water stream can participate a number of times in succession in the regeneration of the liquid collecting means of the side facing the flushing water stream before getting empty.

It is to be noted that, optionally, within the scope of the invention, the liquid collecting means of the side of the liquid collecting element facing away from the flushing water stream, just like those of the side facing the flushing water stream, can release active liquid to the flushing water. Also, the liquid collecting means on the side of the liquid collecting element facing away from the flushing water stream constitute an extra evaporation surface via which evaporation surface the active liquid can evaporate and can freshen the toilet space. As a result, a relatively large amount of active liquid can be released in a toilet flush and between flushes as a result of the evaporation, so that a very good cleaning and freshening is obtained.

It is noted in addition that the channels can be arranged in the liquid collecting element by various methods, depending, for instance, on the material from which the liquid collecting element is manufactured. Thus, the channels may be punched into the liquid collecting element, or be drilled, or be integrally molded as a result of the shape of a molding die, and the like.

According to a further elaboration of the invention, the liquid collecting element is designed as a plate, the plate being provided with a screening to at least partly screen the liquid collecting means of the side facing away from the flushing water stream during use of the flushing water.

This is especially advantageous when these liquid collecting means facing away from the flushing water stream substantially serve for the regeneration of the liquid collecting means of the side of the plate facing the flushing water stream, since the screening means prevent the first-mentioned collecting means from adding an unwanted large amount of active liquid directly to the flushing water during a toilet flush. The active liquid stored in the liquid collecting means of the side facing away from the flushing water stream can therefore be utilized optimally for regeneration of the liquid collecting means facing the flushing water stream. The screening can be designed, for instance, as a downwardly directed wall provided at the edge of the plate and which, starting from the side of the plate facing the flushing water stream, extends in the direction of, and slightly beyond, the side of the plate facing away from the flushing water stream.

According to a preferred embodiment of the invention, the liquid collecting means of the side facing the flushing water stream and/or of the side facing away from the flushing water stream comprise capillary grooves. It is also possible, however, to select a different structure for the liquid collecting means, as long as it contributes to the spread of the liquid over the liquid collecting element and as long as it can be reproducibly manufactured and has accurately defined liquid distributing properties.

Alternative structures can comprise, for instance, wells or projections in a pattern which may or may not be regular, or combinations thereof. A brush-like structure is also an option. Such structures can all be readily manufactured in an injection molding process. By virtue of the injection molding process, the structure is reproducible and hence the liquid distributing properties are known, defined and reproducible.

A liquid collecting element provided with such a structure can moreover be manufactured simply, cheaply and fast. Well-defined and reproducible liquid distributing properties of the liquid collecting means are desirable in particular when the bottle is provided with at least two compartments for active liquid, since these compartments are to release active liquids in a particular fixed ratio to the liquid collecting element for optimum action of the device.

According to an advantageous elaboration of the invention, the liquid collecting element is provided with positioning projections and/or walls for positioning the liquid collecting element in the holder.

Thus, the liquid collecting element can be attached relatively simply and firmly to, for instance, parts of the holder engaging the projections and/or walls mentioned.

According to a further elaboration of the invention, the device may be provided with at least two compartments for active liquid, the liquid collecting means on the liquid collecting element being separated from each other, such that, also on the liquid collecting element, the active substance from a first compartment does not mix with active substance from a second compartment.

The invention will now be further elucidated with reference to the accompanying drawings. In the drawings.

Figure 16:
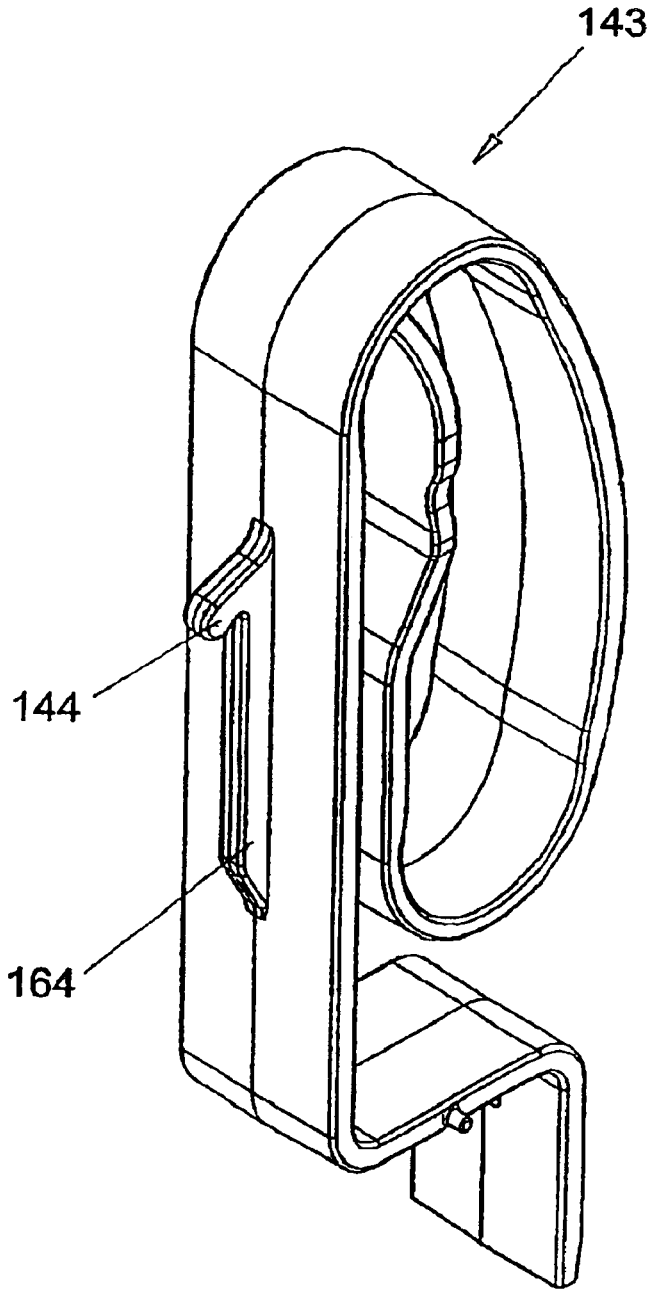
Figure 17:
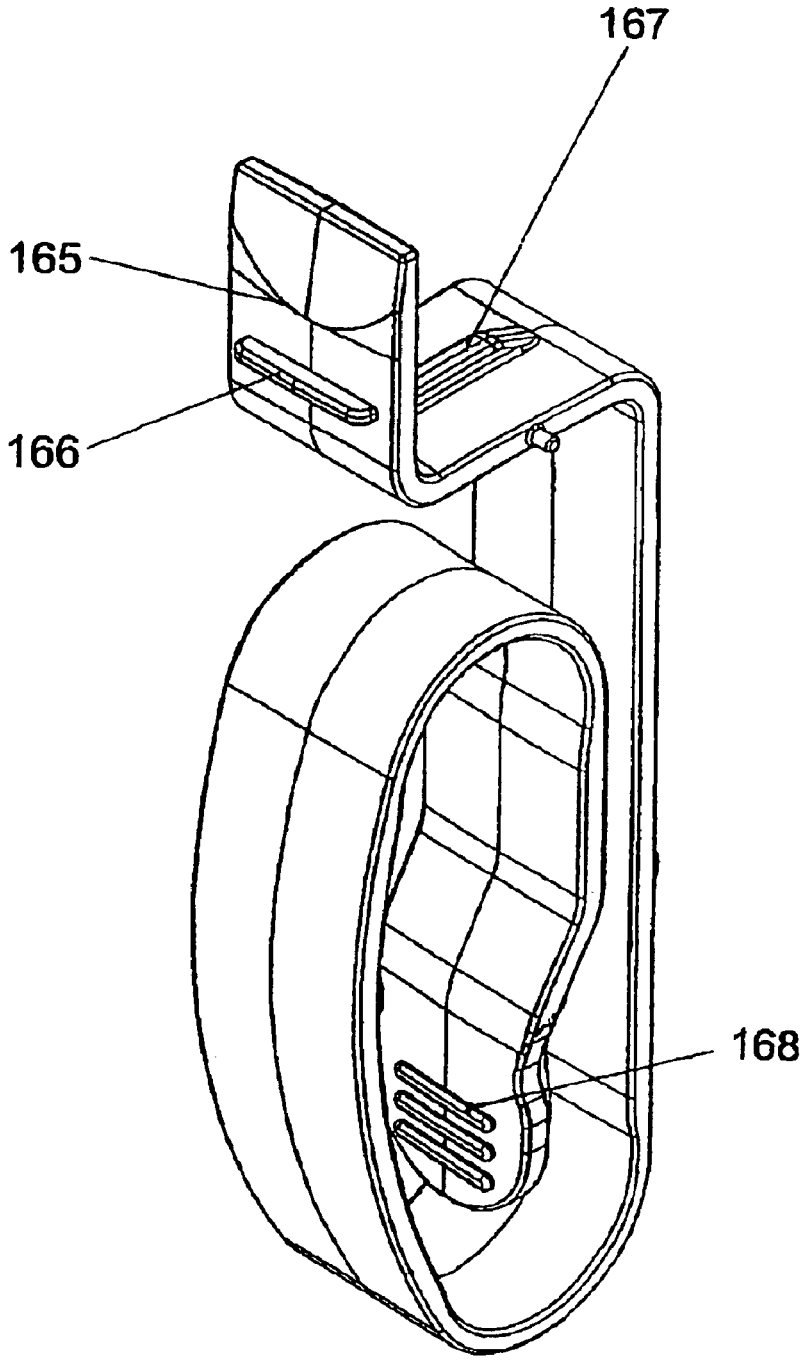
Figure 18:
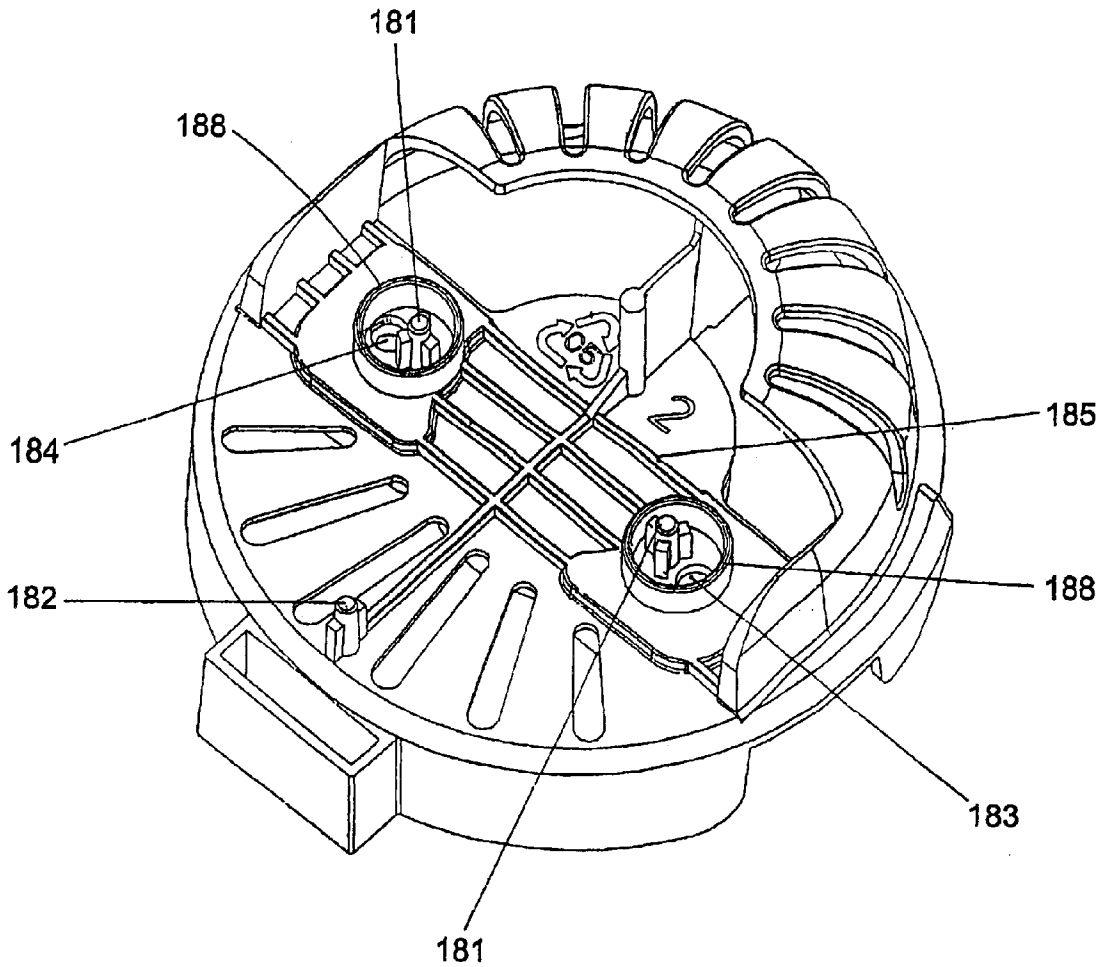
Figure 19:
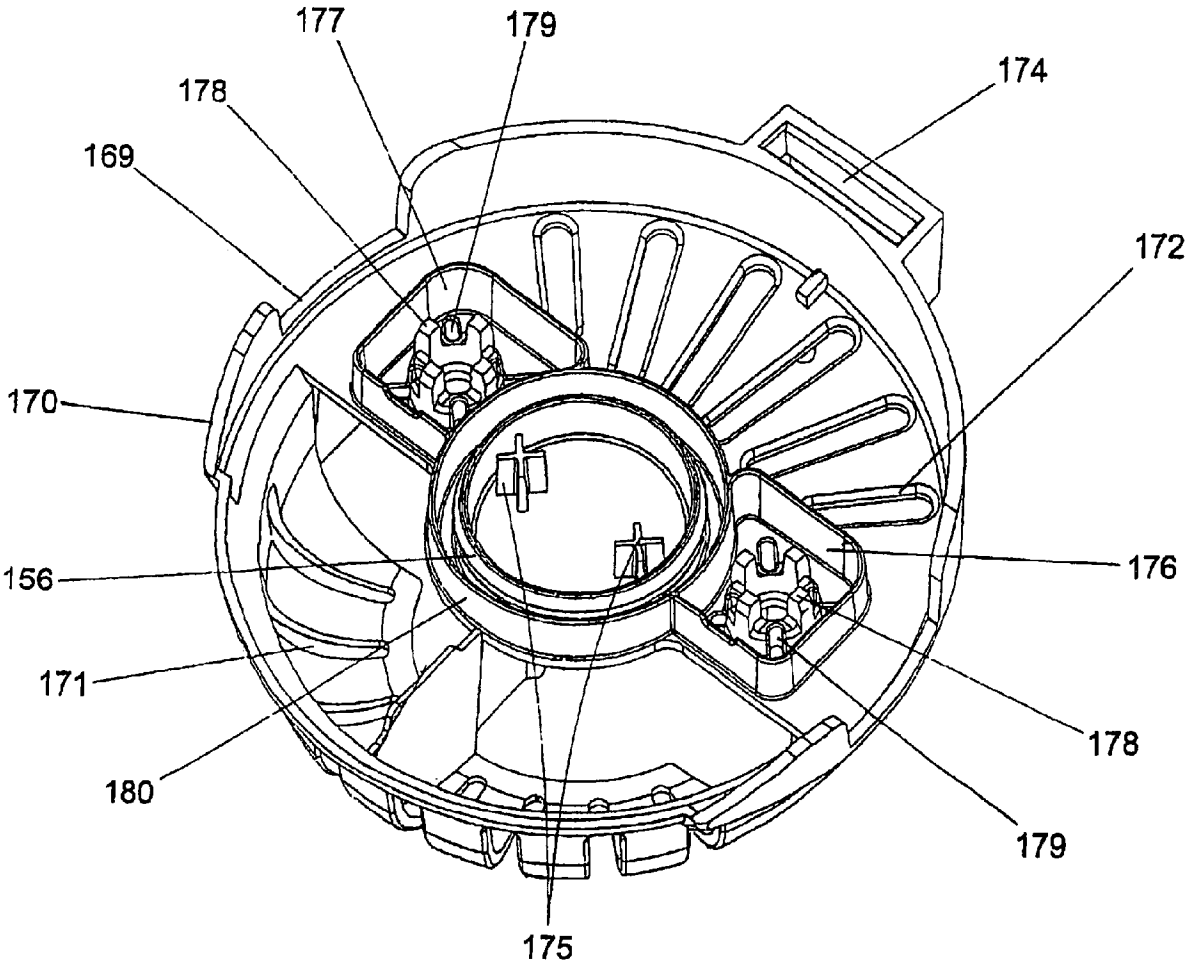
Figure 20:
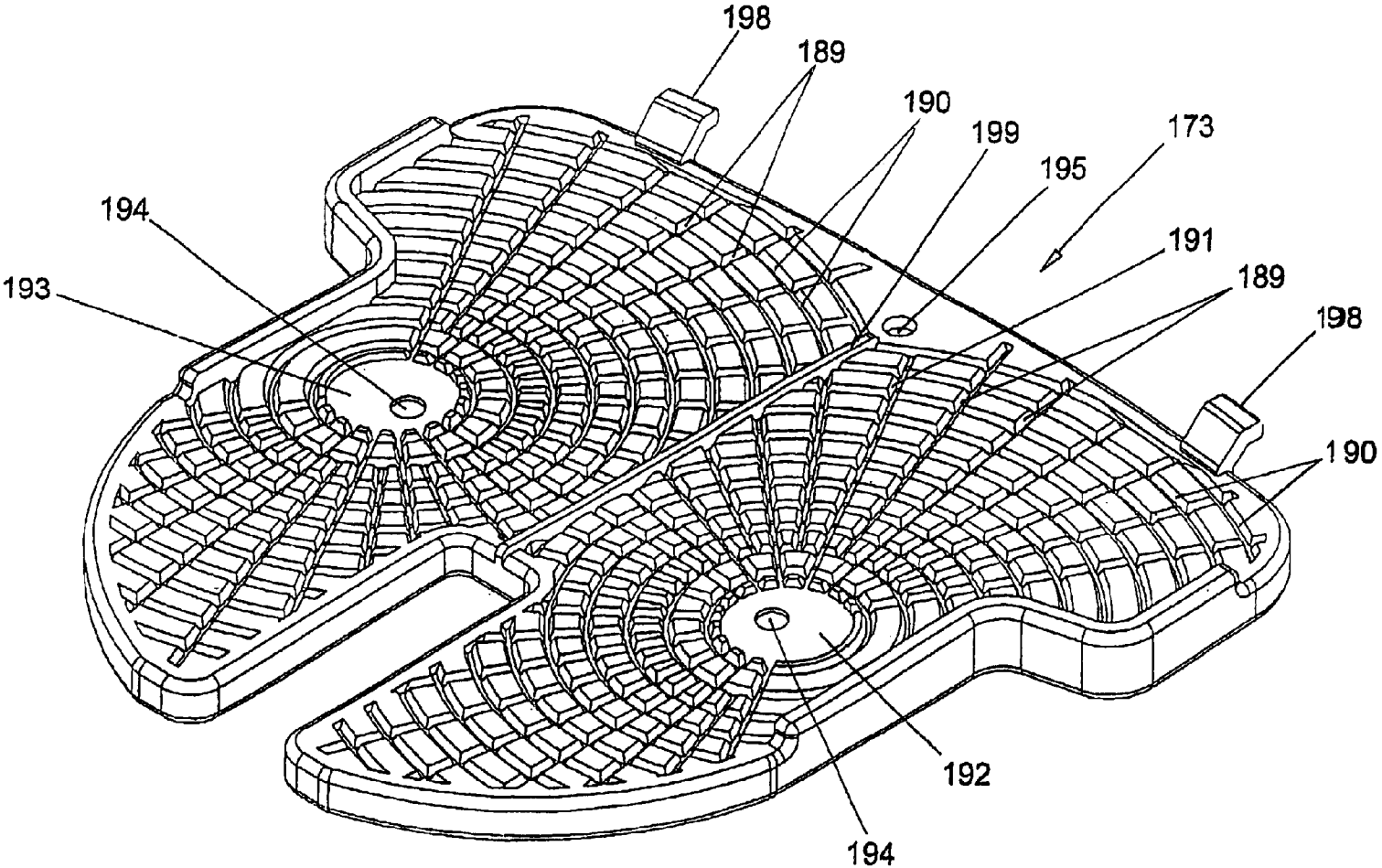
Figure 21:
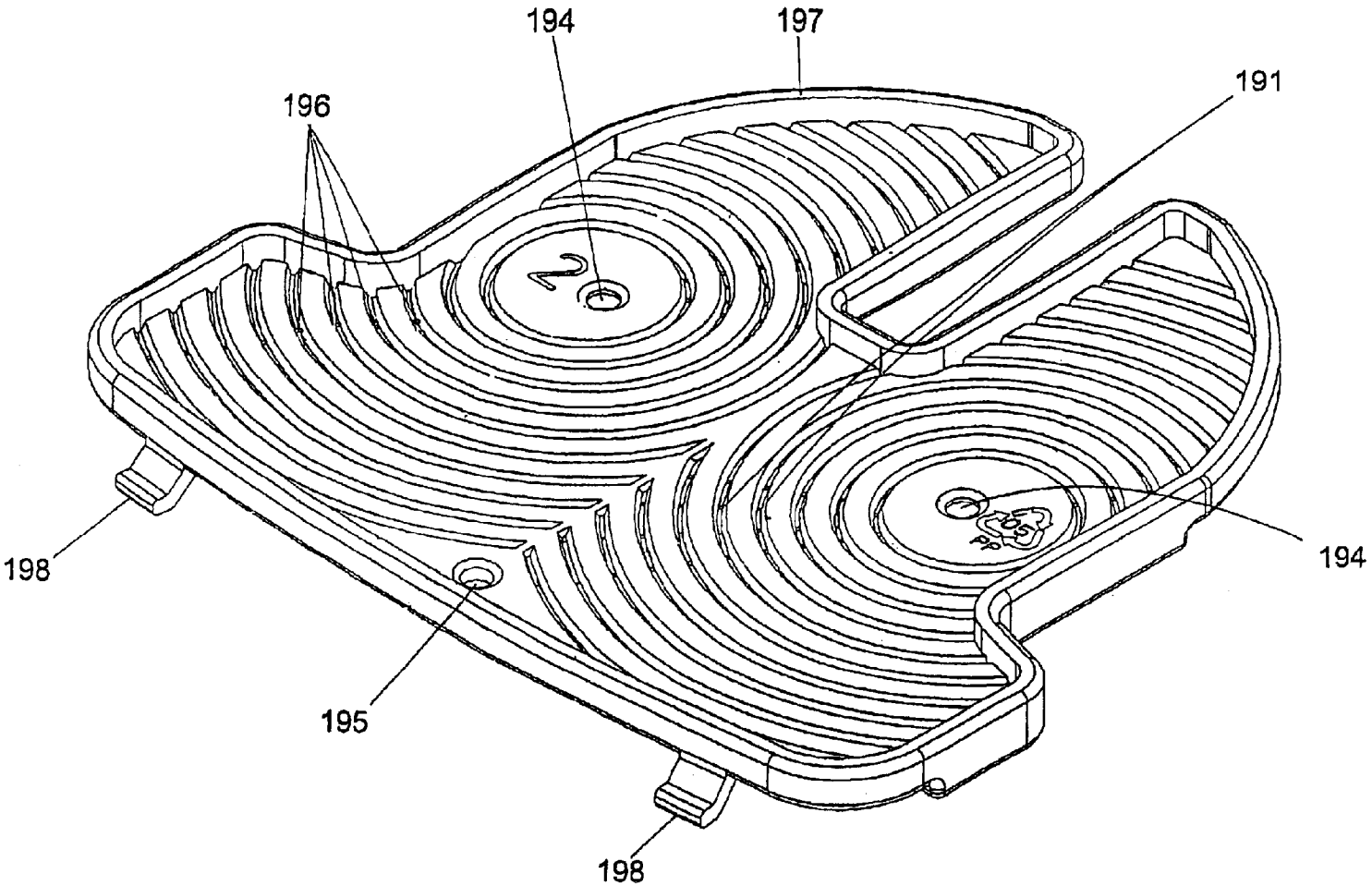
Figure 23:
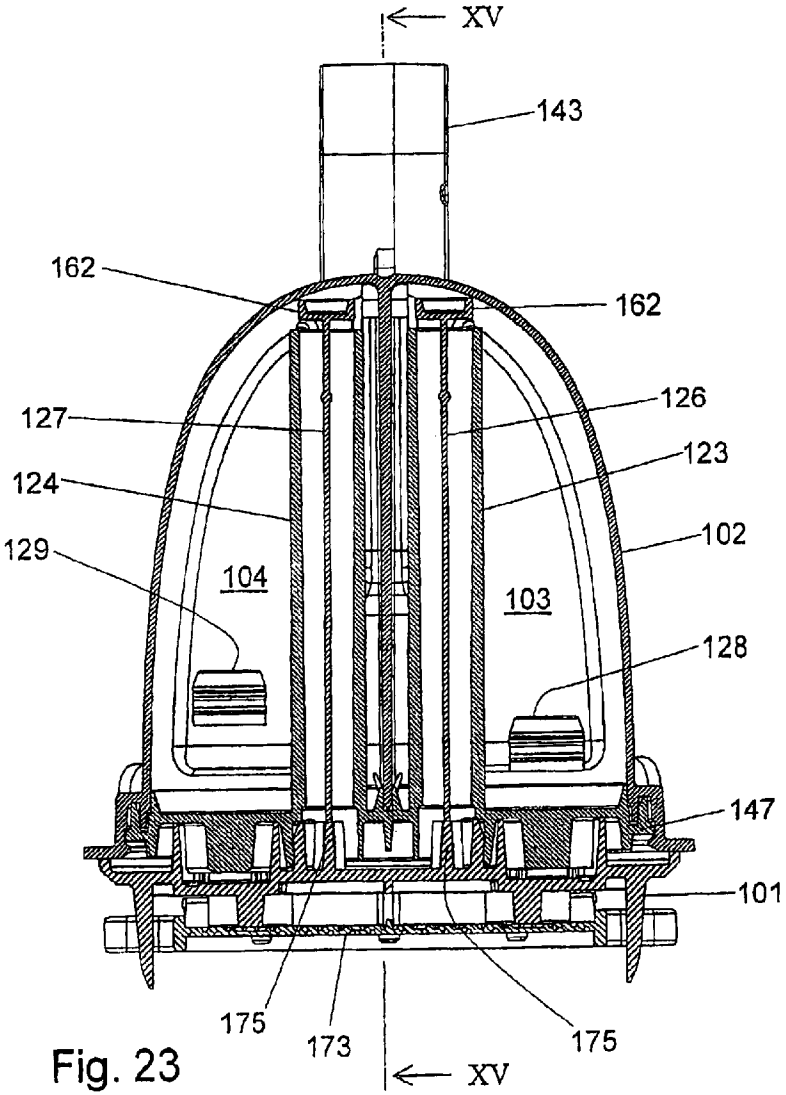
Figure 22:
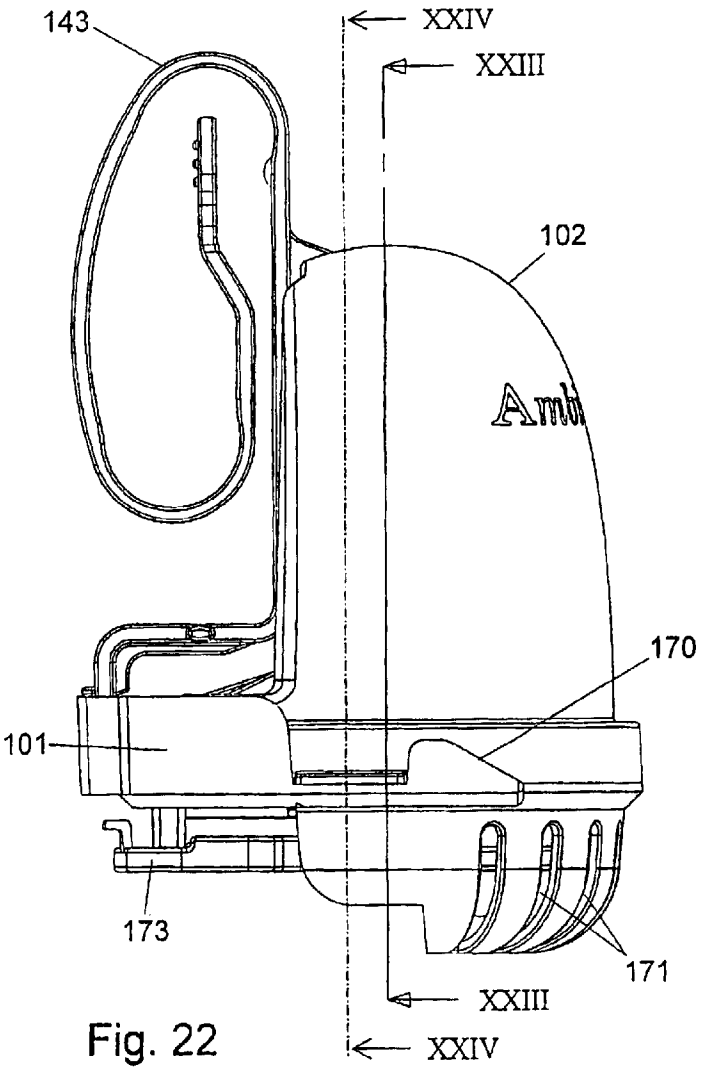
Figure 24:
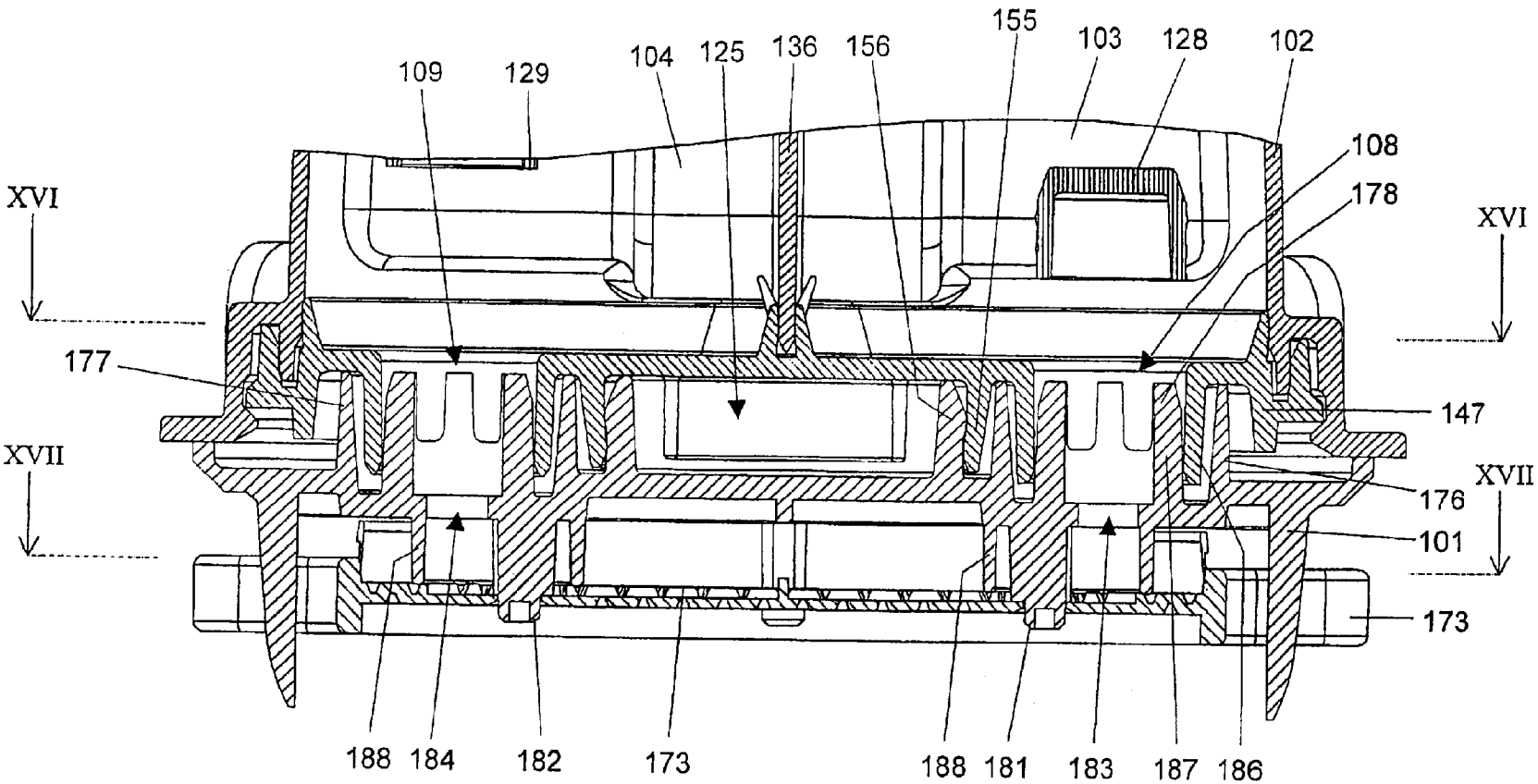
Figure 25:
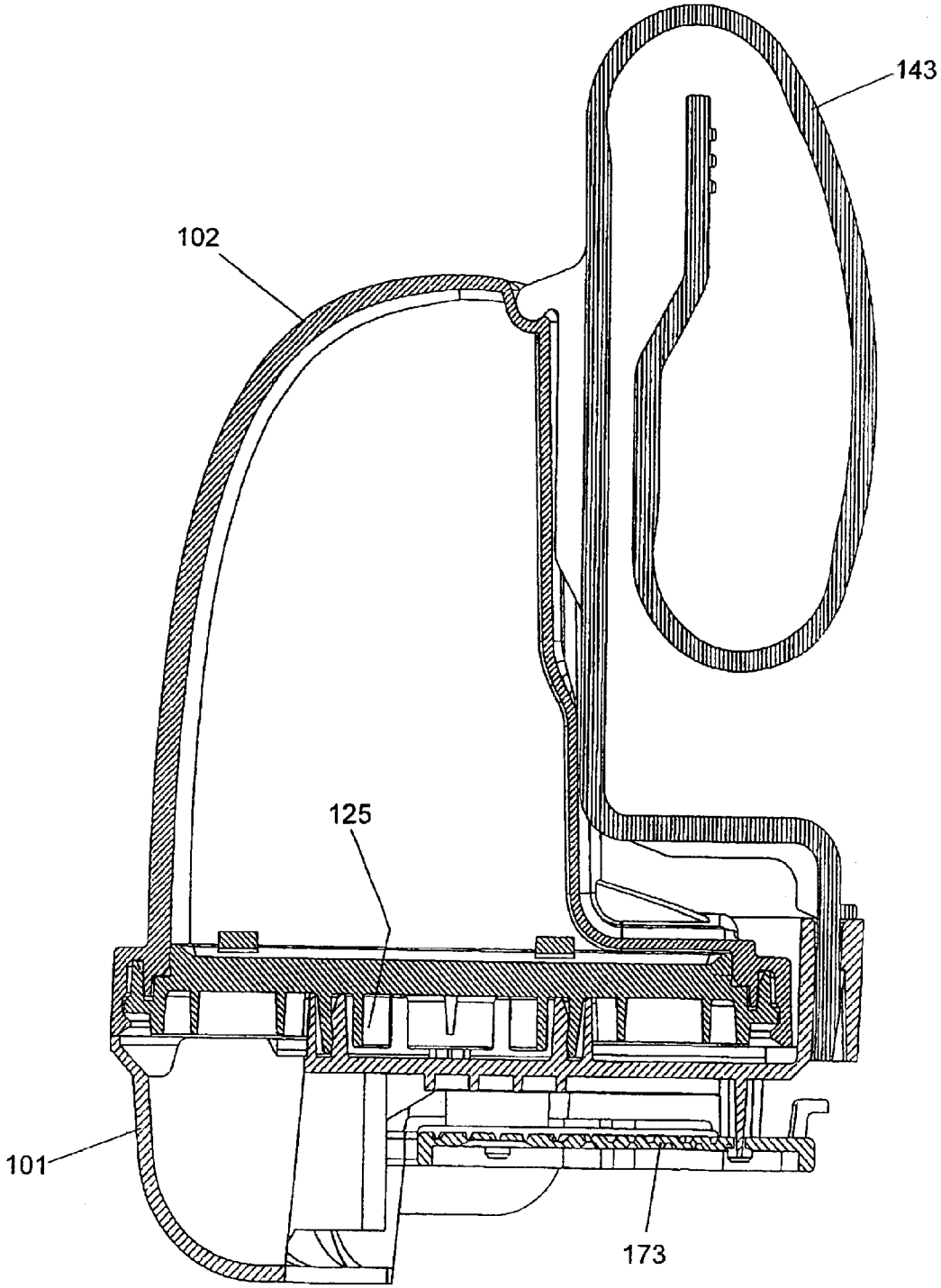
Figure 26:
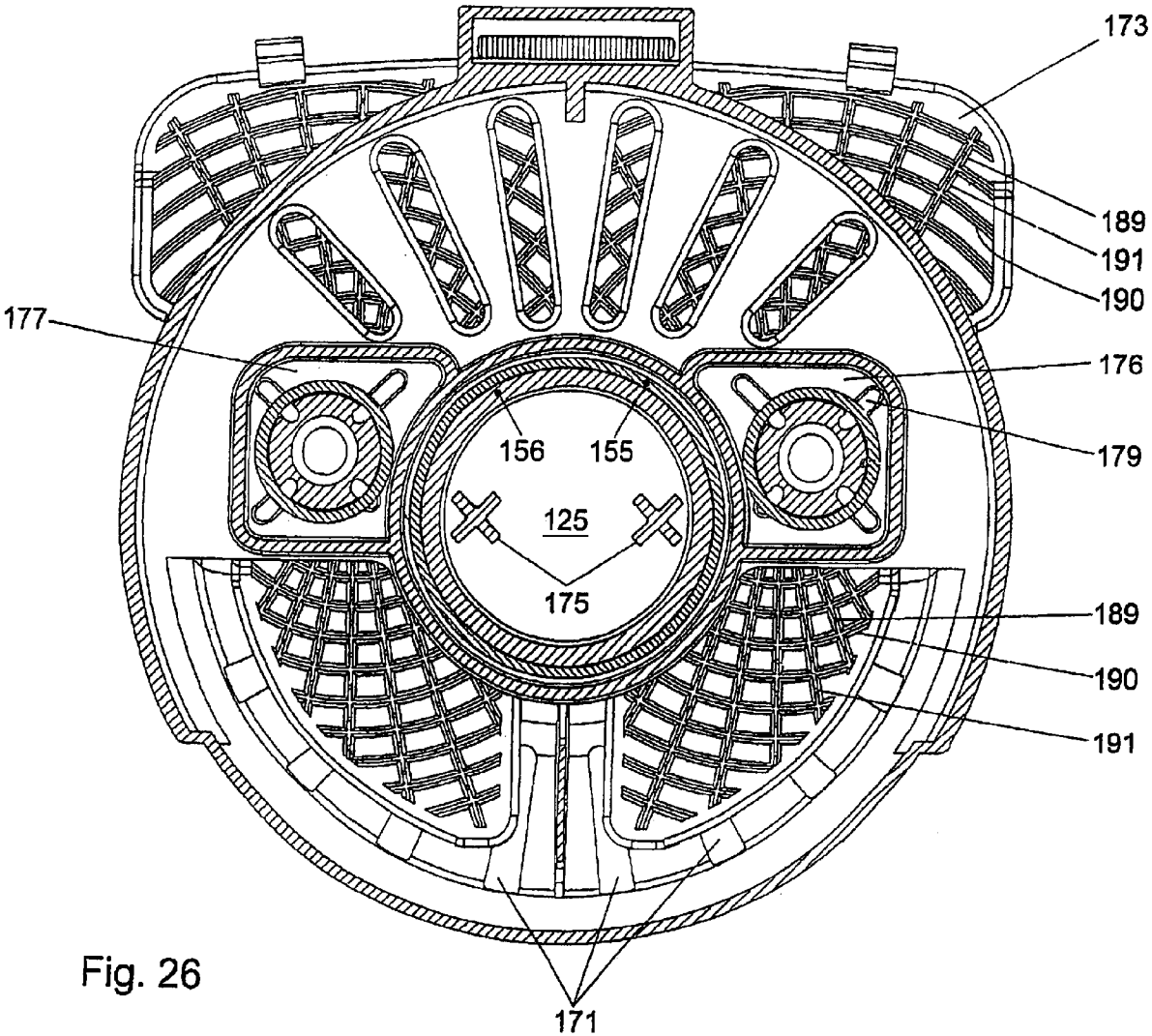
Figure 27:
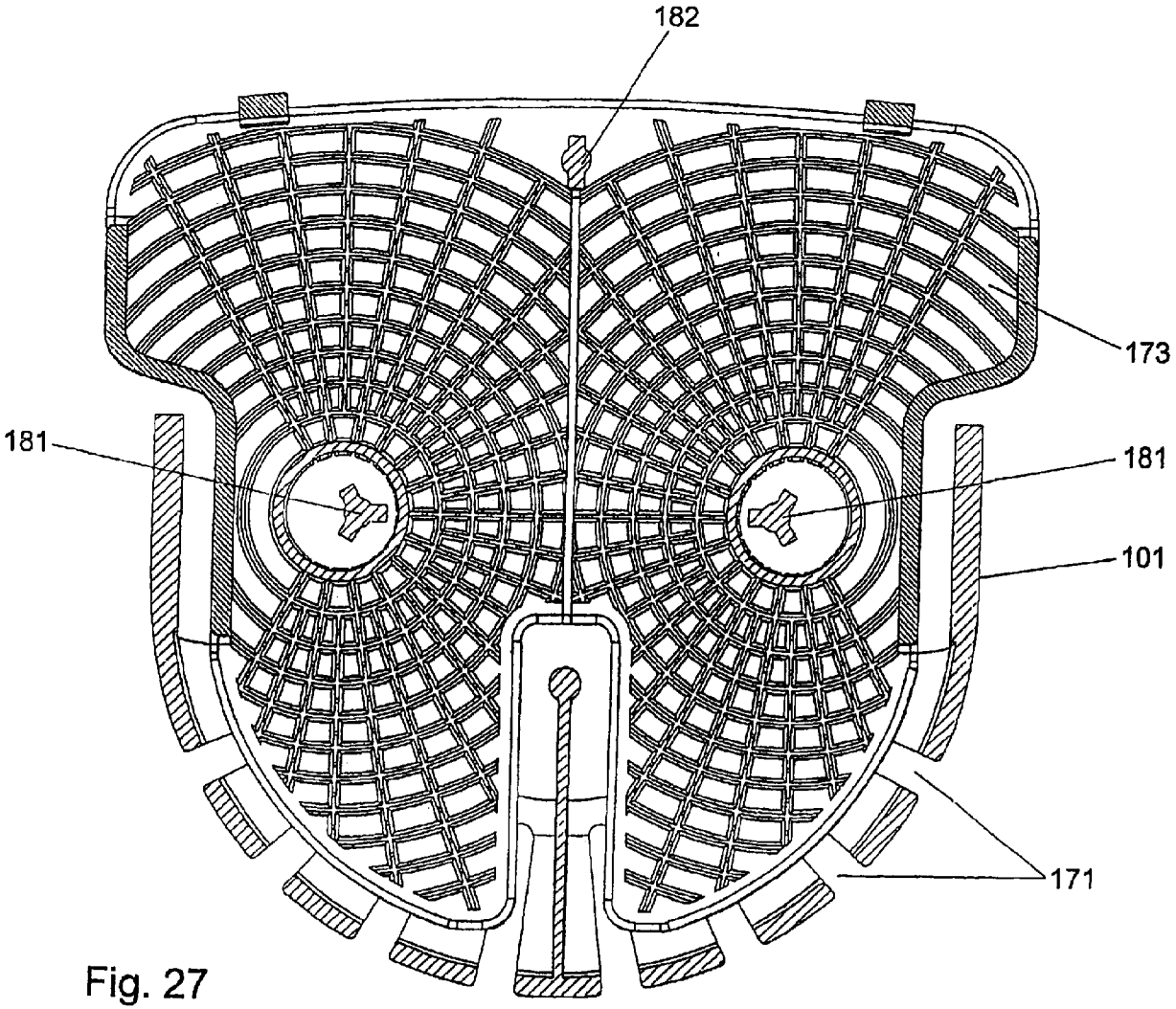

FIGS. 16 and 17 both show a perspective view of a flexible bracket with the aid of which the device can be suspended from the rim of a toilet bowl;

FIGS. 18 and 19 show a bottom and top plan view, respectively, of the holder onto which the bottle can be fixed;

FIGS. 20 and 21 show a perspective top and bottom plan view, respectively, of a liquid collecting element used in the third exemplary embodiment;

FIG. 22 shows a side view of the third exemplary embodiment;

FIG. 23 shows a cross-sectional view along line XXIII—XXIII of FIG. 22 over the tubular elements;

FIG. 24 shows in detail the outflow openings of the bottle in mounted condition on the holder;

FIG. 25 shows a cross-sectional view along line XXV—XXV of FIG. 23;

FIG. 26 shows a cross-sectional view along line XXVI—XXVI of FIG. 24; and FIG. 27 shows a cross-sectional view along line XXVII—XXVII of FIG. 24.

Figure 1:
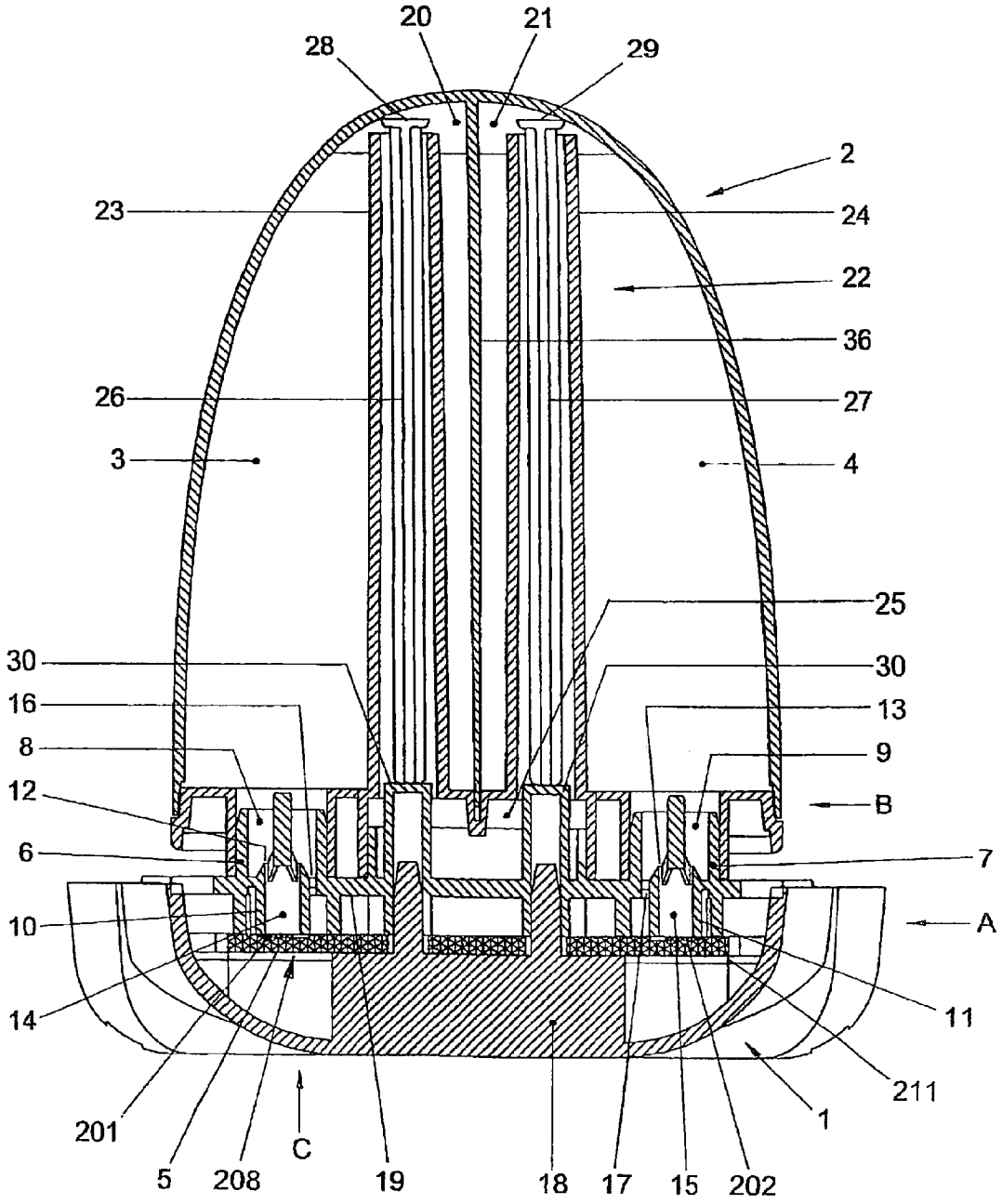
FIG. 1 shows a longitudinal section of an exemplary embodiment of the device according to the invention.
Figure 2:
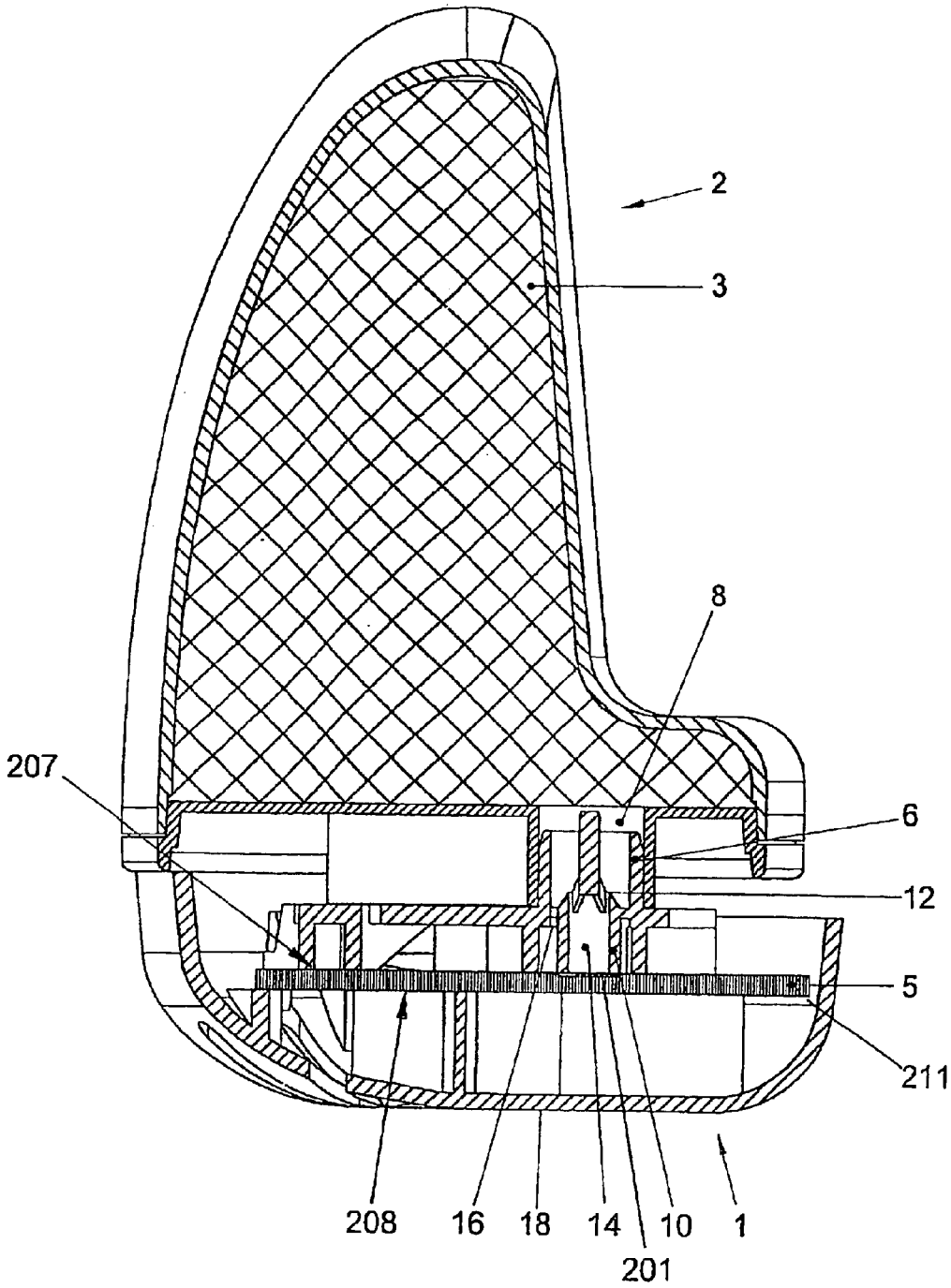
FIG. 2 shows a longitudinal section of this exemplary embodiment, perpendicular to the longitudinal section of FIG. 1, at the location indicated with C in FIG. 1.

The exemplary embodiment represented in FIGS. 1–2 of a device with toilet care action according to the invention comprises a holder 1 and a bottle 2, detachably connected to the holder, with a reservoir for an active liquid. Here, this reservoir has two compartments 3 and 4, separated by a wall 36. The suspension means connected with the holder for suspending the device from the rim of the toilet bowl are not represented here. The device is further provided with a liquid collecting element 5 in the form of a plate 5 provided with capillary grooves 203, 204, 205, which, when the bottle 2 has been pressed onto the holder 1, is always in fluid communication with the liquid in the compartments 3 and 4. The plate 5 is arranged in the holder 1 in such a way that it is located in a path of the flushing water with the device in a condition suspended from the rim of the toilet bowl.

Figure 4:
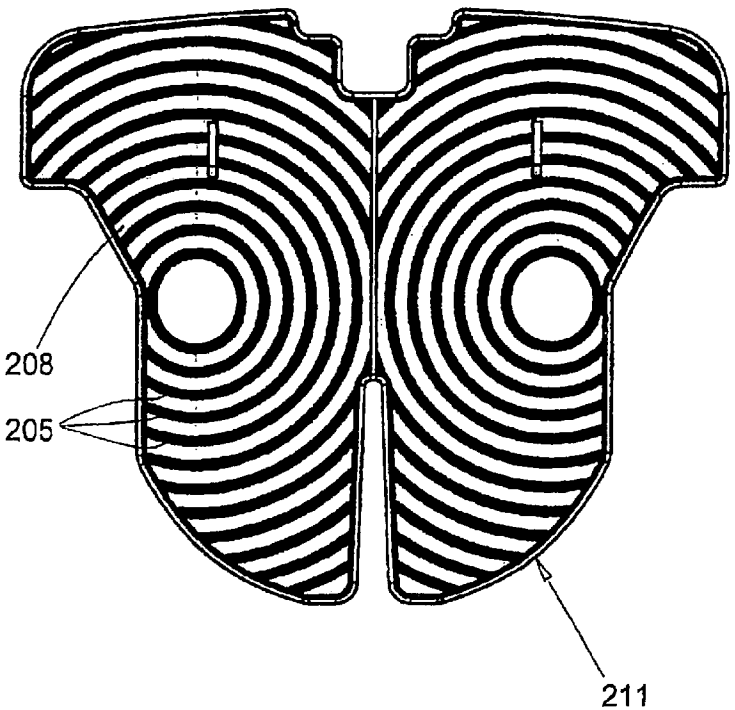
FIG. 4 shows a bottom view of the top plan view represented in FIG. 3.
Figure 3:
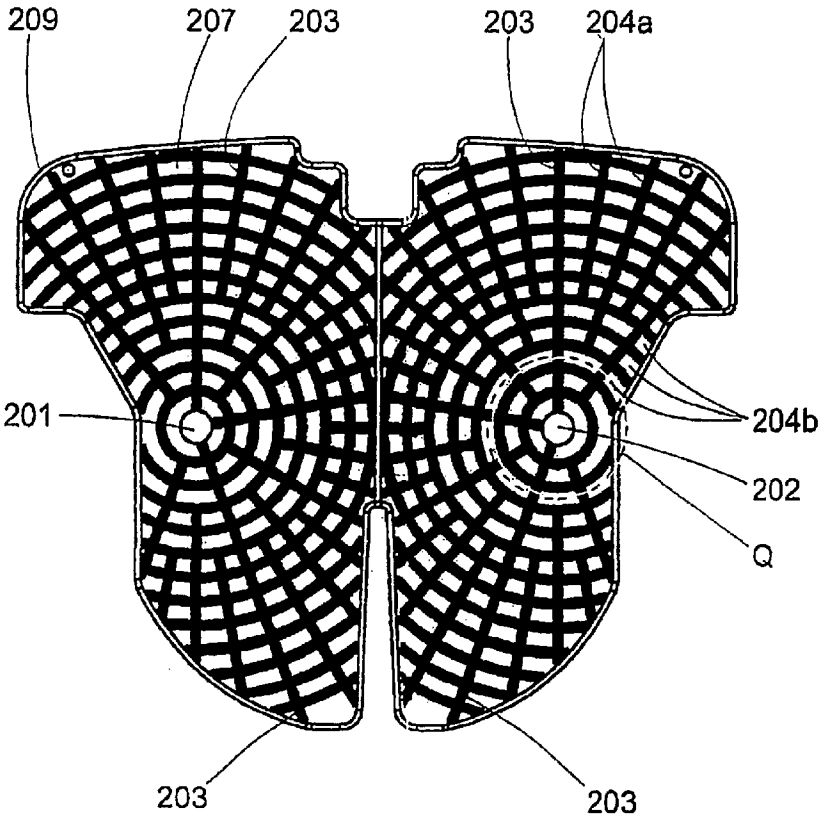
FIG. 3 shows a top plan view of a liquid collecting plate provided with capillary grooves.
Figure 5:
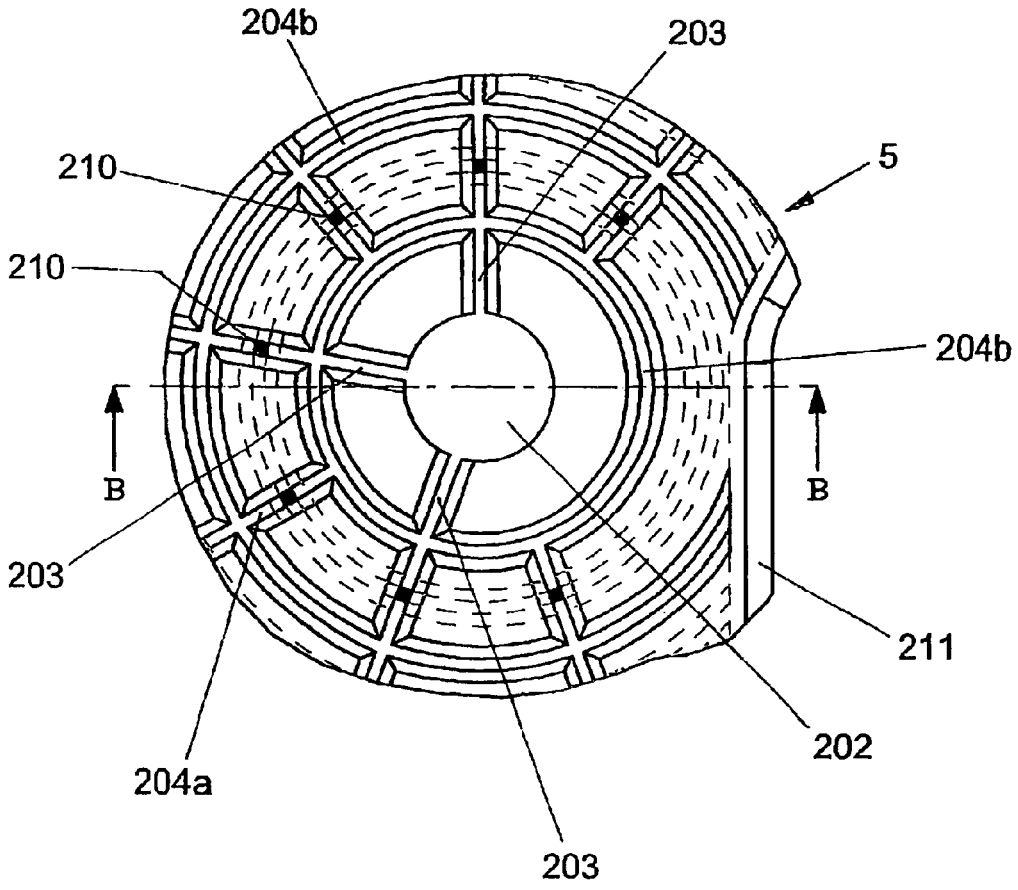
FIG. 5 shows detail Q of the top plan view represented in FIG. 3.

As shown in FIGS. 3 and 4, the plate 5 is provided both on the side 207 facing the flushing water stream and on the side 208 facing away from the flushing water stream, with grooves 203, 204 and 205, respectively, which grooves have been represented in solid black for clarity. The grooves on the side facing the flushing water stream are divided into three straight main grooves 203 which extend from liquid receiving areas 201, 202 to the edge of the plate 5. Further, the side 207 of the plate 5 facing the flushing water stream is provided with a number of straight subgrooves 204*a* and a number of circular subgrooves 204*b*, which are connected with each other and/or the main grooves 203. Jointly, these grooves constitute a spider web-like groove network substantially centered on the receiving areas 201, 202.

Figure 6:
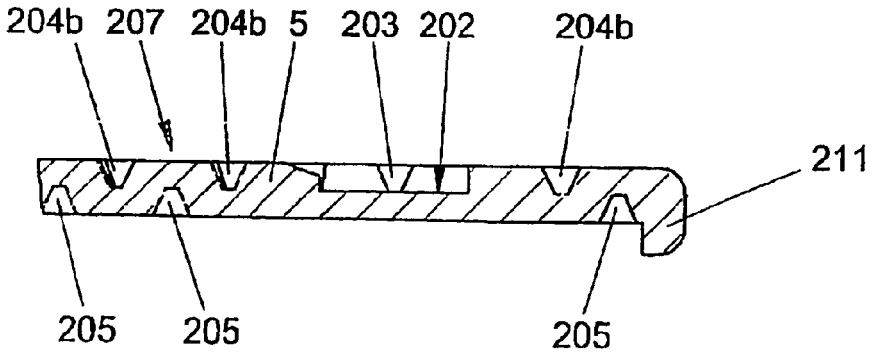
FIG. 6 shows a cross section along line B—B of the detail Q represented in FIG. 5.

The grooves 205 on the side 208 of the plate 5 facing away from the flushing water stream extend concentrically along circular paths in the plate 5. These grooves 205, at least viewed in the cross section of the plate 5, do not overlap the circular grooves 204*b* of the side 207 of the plate 5 facing the flushing water stream, see FIG. 6. The edge of the side 208 of the plate 5 facing away from the flushing water stream is further provided with an upstanding wall 211 which, starting from the side 207 of the plate 5 facing the flushing water stream, extends in the direction of and beyond the side 208 of the plate 5 facing away from the flushing water stream.

The grooves 203, 204 of the side 207 of the plate 5 facing the flushing water stream are connected by way of capillary channels 210 in the plate 5 with the circular grooves 205 of the side of the plate facing away from the flushing water stream. The circular grooves 205 are substantially equidistantly spaced from each other, for instance at a mutual distance which is in the range of 0.1–4 mm, more particularly at a distance in the range of 1–3 mm. The perforations 210 referred to can have a diameter in the range of, for instance, 0.05–0.5 mm.

As shown in FIGS. 1 and 2, the holder 1 is provided with two connecting nipples 6 and 7 to which a respective outflow opening 8, 9, respectively, of the compartments 3, 4, respectively, is connectable, so that the outflow openings, in the condition suspended from the rim of the toilet bowl, are directed downwards. In the condition connected to the connecting nipple 6, 7, respectively, the outflow openings 8 and 9 are partly closed off by a closing wall 10, 11, respectively, each of which is provided with at least one liquid passage opening 12, 13, respectively, which terminates in a channel 14, 15, respectively. The outlet of each of these channels 14, 15 is in communication with a respective liquid receiving area 201, 202 situated on the side 207 of the plate 5 facing the flushing water stream.

Liquid coming from the compartments 3, 4 is received on the plate 5 on the respective liquid receiving areas 201, 202 and taken up by the capillary groove networks 203, 204, 205 of the plate 5. As the toilet is flushed, the grooves 204, 205 of the side of the plate 5 facing the flushing water stream release active liquid to the flushing water. Thereafter, these grooves 203, 204 are regenerated by liquid coming from the compartments 3, 4 and by liquid from the grooves 205 of the side 208 of the plate facing away from the flushing water stream. Therefore, regeneration can proceed relatively fast. Moreover, quantities of liquid from the two compartments that are accurately tuned to each other can be received by the grooves 203, 204, 205 of the plate 5.

The operation of the holder and the outflow of liquid from a compartment from the exemplary embodiment of FIGS. 1 and 2, for that matter, is identical to that described in European patent application 0 785 315. The contents of this European patent application EP 0 785 315 are understood to form part of the description given here of the embodiment of FIGS. 1–2.

Figure 7:
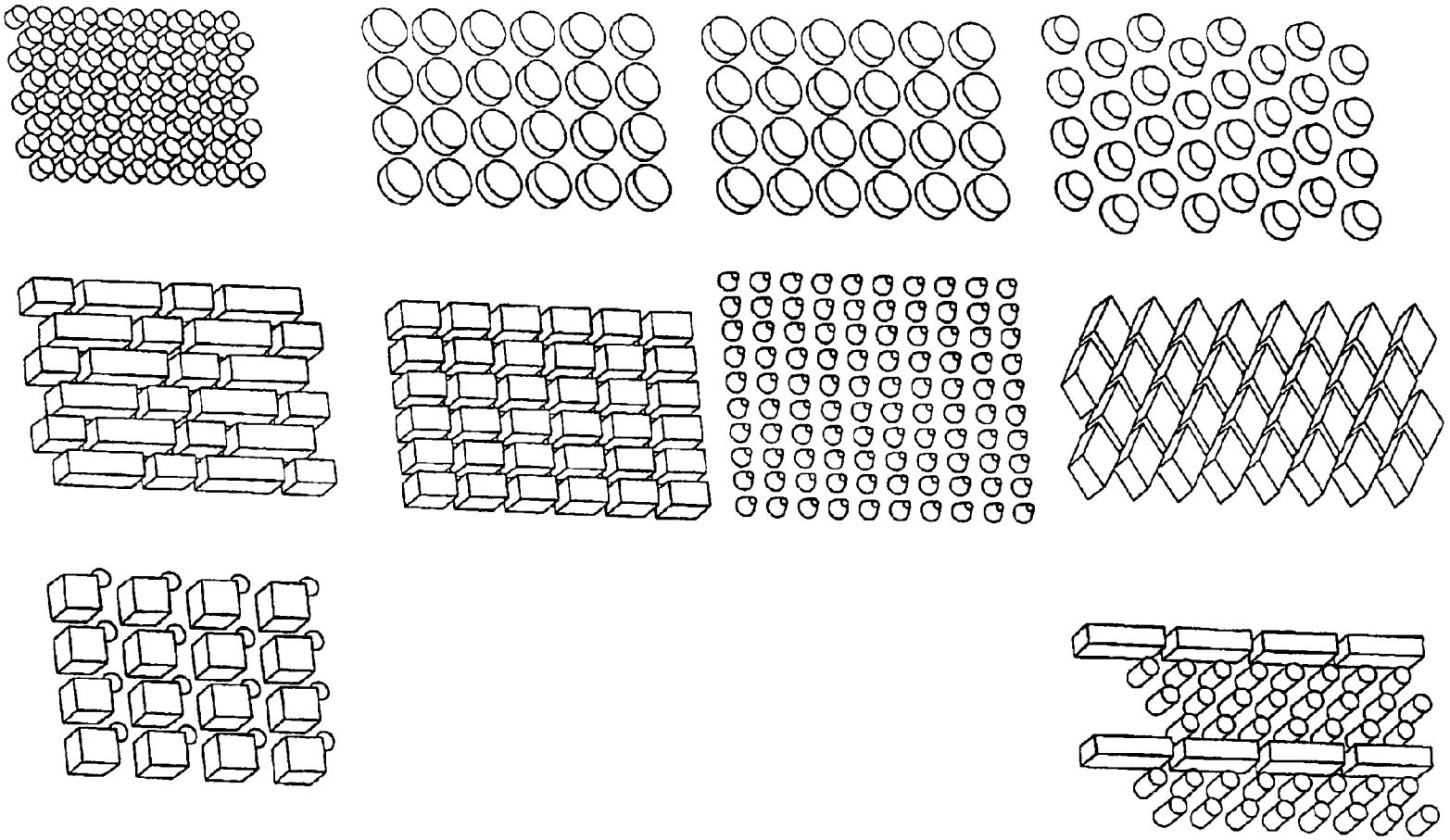
FIG. 7 shows a number of examples of other structures that may be provided on the top side of a liquid collecting element and on the side thereof facing away from the flushing water stream, so as to provide liquid collecting means.

FIG. 7 shows a number of alternative structures which can be arranged on opposite sides of the substantially plate or tray-shaped liquid collecting element 173. Here, it should be noted that this is only a limited number of examples which can also comprise other structures such as injection-molded brush structures or projections or indentations provided in a random pattern.

FIGS. 8–28 relate to a second exemplary embodiment according to the invention. First, the various molded parts will be discussed separately and thereafter the exemplary embodiment in assembled condition.

Figure 8:
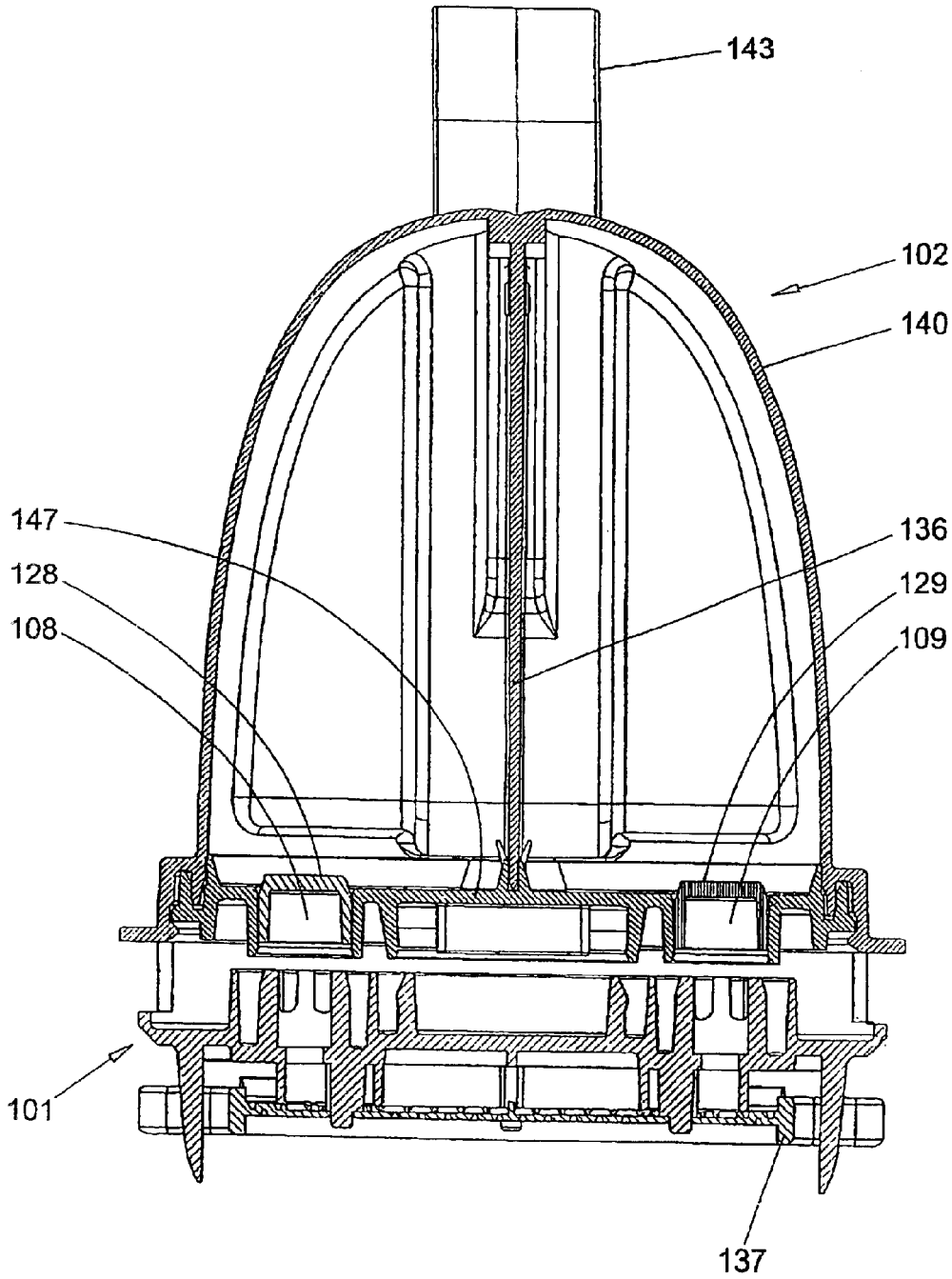
FIG. 8 shows a cross sectional view along line XXIV—XXIV of FIG. 22 through the outflow openings of a third exemplary embodiment according to invention, with the bottle not yet placed on the holder.

FIG. 8 shows a longitudinal cross section passing through the outflow openings of the bottle 102, with the bottle 102 not yet placed on the holder 101. As in the exemplary embodiment of FIGS. 1–6, the bottle 102 has been manufactured from four molded parts, i.e. the reservoir (the first molded part shown in FIGS. 9 and 10) the bottom of which is closed off with a closing cap (the second molded part shown in FIGS. 11 and 12). The closing cap 147 supports the two tubular elements 123, 124, in which the rod-shaped closing elements 126, 127 (the third molded parts shown in FIG. 13) are included. These rod-shaped elements 126,127 are formed by separate molded parts. In the closing cap 147, the liquid outflow openings 108, 109 are closed off by sealing plugs 128, 129 (the fourth molded parts shown in FIGS. 14 and 15). The suspension means 143 are formed by a separate molded part (FIGS. 16 and 17) which, after being injection molded, is connected to the holder 101. The holder 101, which is also a separate molded part, is represented in FIGS. 18 and 19. To the bottom side of this holder, a liquid collecting element 173 (FIGS. 20 and 21), in this example manufactured by injection molding, can be attached.

Before proceeding to the discussion of the manner in which the various molded parts cooperate in assembled condition, first, the molded parts will be discussed separately.

Figure 9:
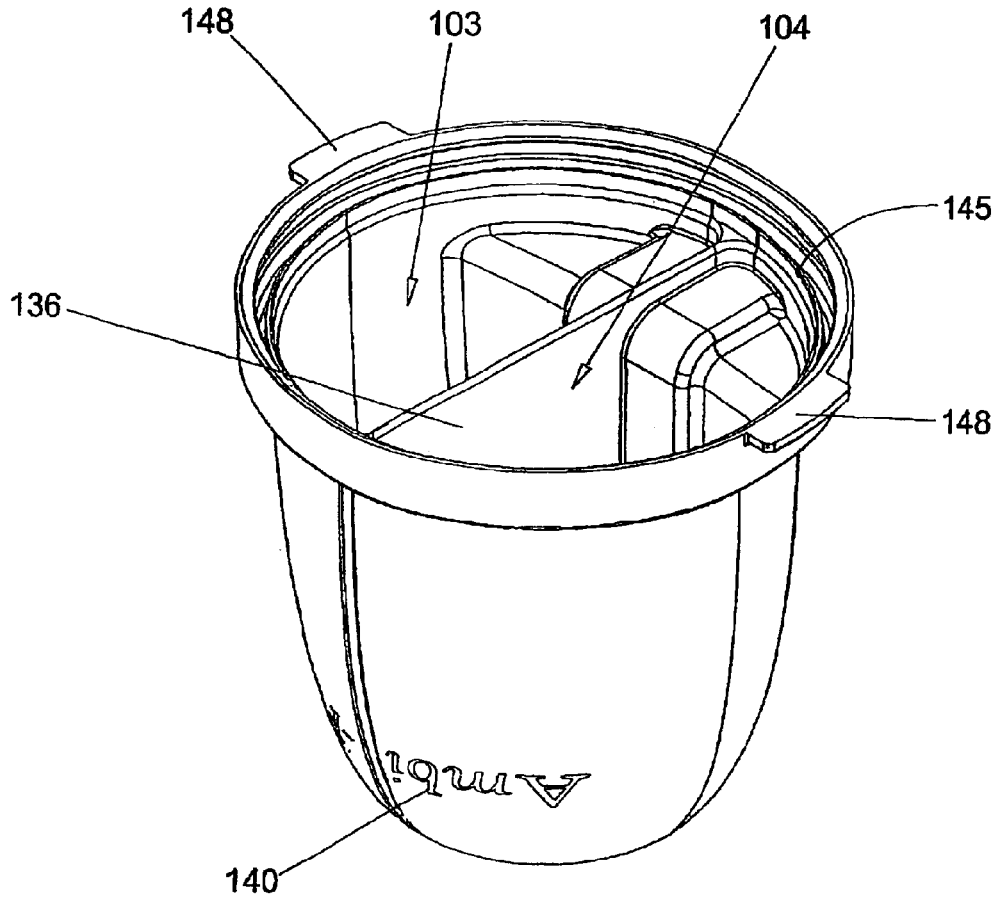
FIG. 9 shows a perspective view of the bottom side of the bottle.
Figure 10:
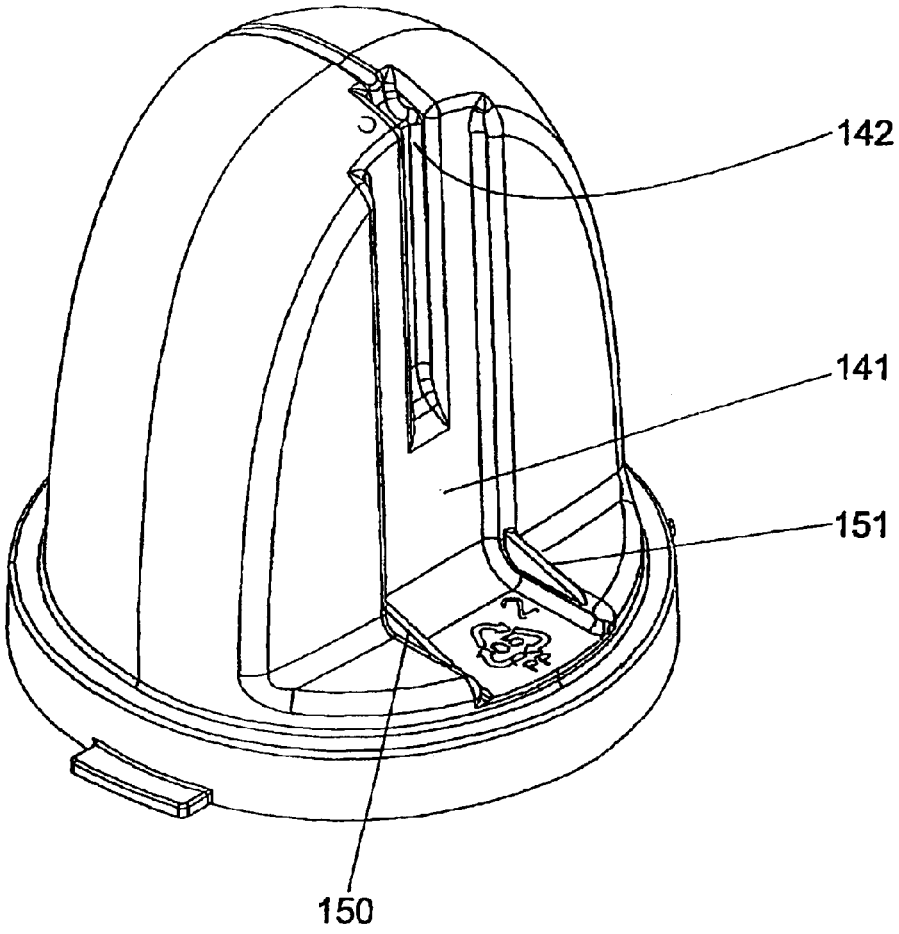
FIG. 10 shows a perspective view of the upper side of the bottle.
Figure 11:
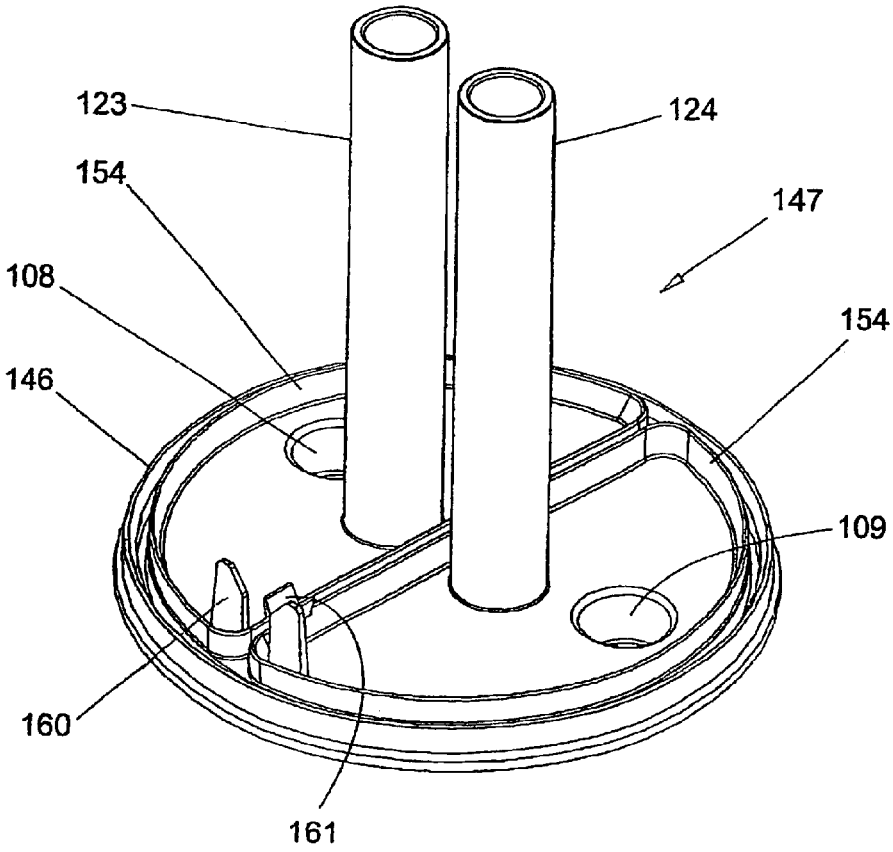
FIG. 11 shows a perspective view of the upper side of the closing cap.
Figure 12:
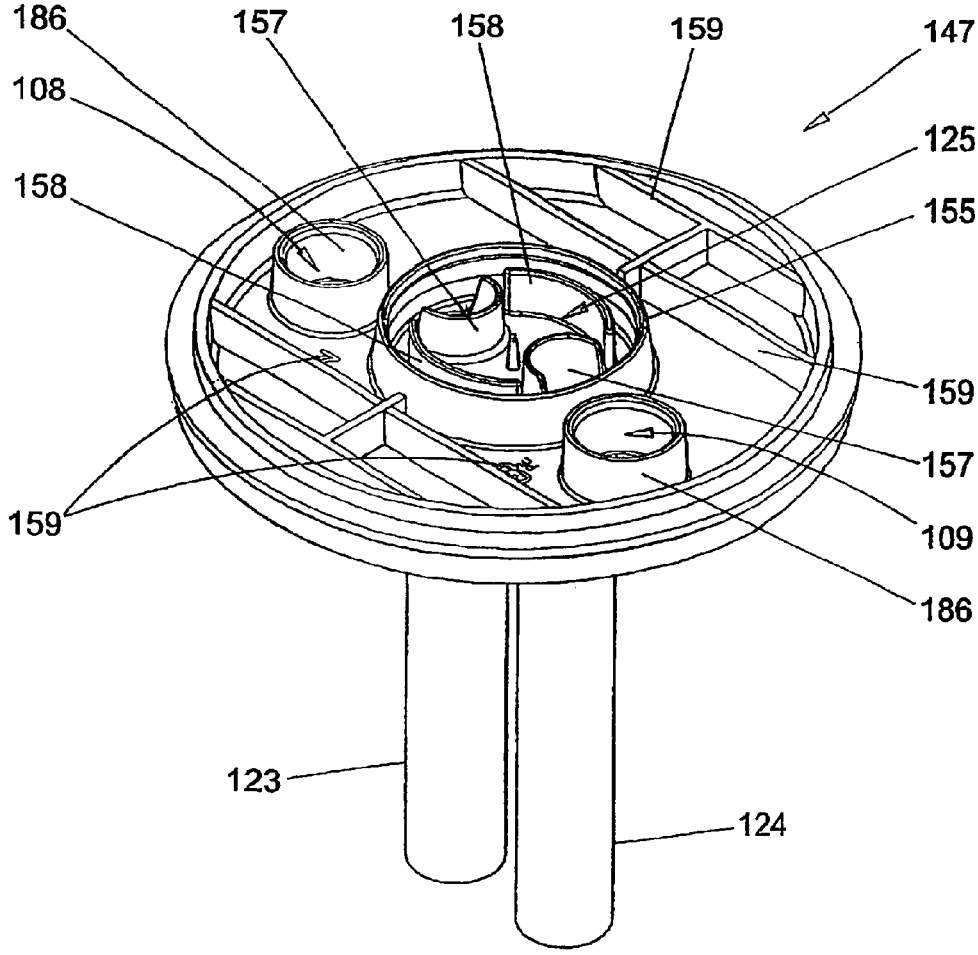
FIG. 12 shows a perspective view of the bottom side of the closing cap.

The reservoir shown in FIGS. 9 and 10 comprises an outer wall 140 bounding an inner space in which a dividing wall 136 is arranged. The outer wall 140 and the dividing wall 136 together bound two compartments 103, 104, which, in use, each contain an active liquid of a different formula. FIG. 10 shows the side of the reservoir against which the suspension means 143 is to abut. Clearly visible is a recess 141 having the width of the suspension means 143. Also, a deeper recess 142 is represented in which a hooking element 144, disposed on the suspension means 143, can engage. FIG. 9 clearly shows a sealing edge 145 which cooperates with a sealing edge 146 on the closing cap 147 which is represented in FIGS. 11 and 12. Further, the reservoir is provided with two ears 148, 149 and two guiding partitions 150, 151, which are to simplify the fitting of the reservoir to the holder 101.

As already noted hereinabove, the closing cap represented in FIGS. 11 and 12 supports the two tubular elements 123, 124 in which the rod-shaped closing elements 126, 127 (FIG. 13) are included. The closing cap 147 is further provided with two outflow openings 108 and 109 in which, in non-assembled condition, sealing plugs 128, 129 are received. The closing cap 147 of FIGS. 11 and 12 further clearly shows the sealing edge 146 which cooperates with the sealing edge 145 of the reservoir. Further, two second sealing edges 154, closed in themselves, are shown which abut against the compartment walls of the reservoir. The bottom side of the closing cap 147, which is represented in FIG. 12, clearly shows the air chamber 125 which is bounded by a sealing wall 155, which, in assembled condition, cooperates with a sealing edge 156 engaging thereon in the holder 101. Further, two screening elements 157 are visible, which prevent the rod-shaped closing elements 126, 127 from being inadvertently pushed into the opened position. The screening elements 158 prevent the closing wall 155 from being damaged before the bottle 102 is fitted onto the holder 101. With reference numeral 159, reinforcing partitions are indicated preventing the closing cap 147 from warping. With reference numerals 160 and 161, centering elements are indicated which enable a simple assembly of the reservoir on the closing cap 147.

Figure 13:
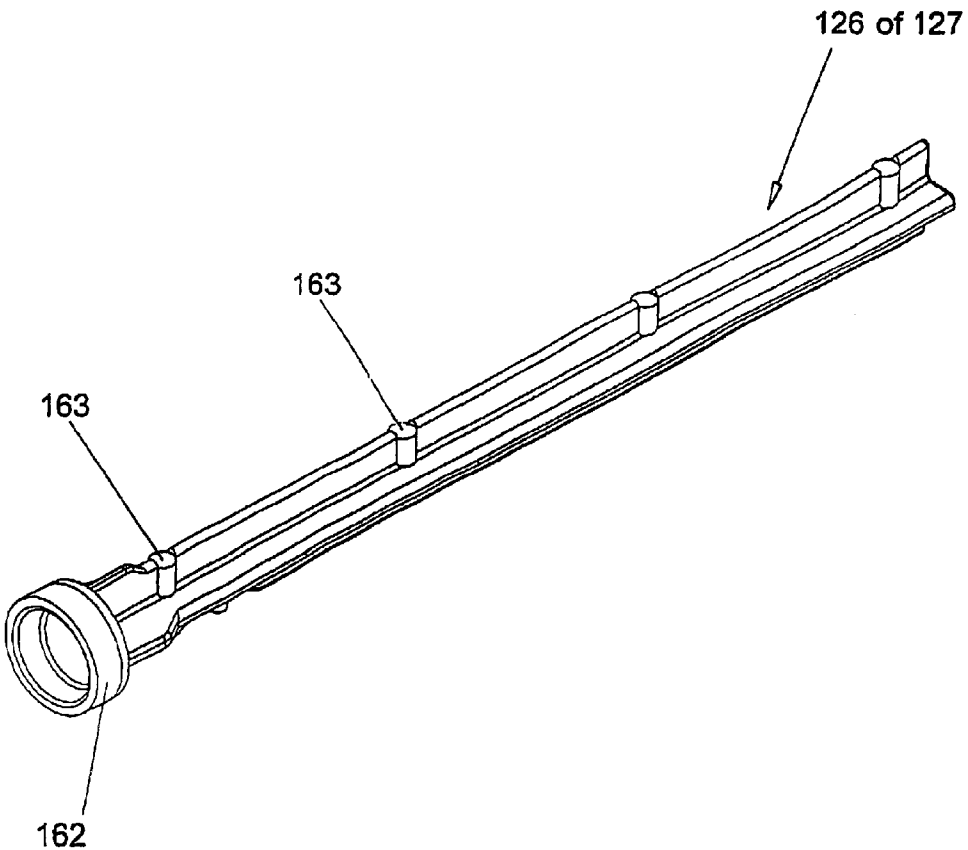
FIG. 13 shows a perspective view of a closing element.

The rod-shaped element represented in FIG. 13 is provided with a sealing head 162 which seals off a side facing the flushing water stream, of a tubular element 123, 124 of the closing cap 147 in an air-tight manner, in the non-assembled condition of the bottle 102. The cylinder-shaped parts 163 represented on the shank form the locations where the rod-shaped element is ejected from the mould and is injected.

Figure 15:
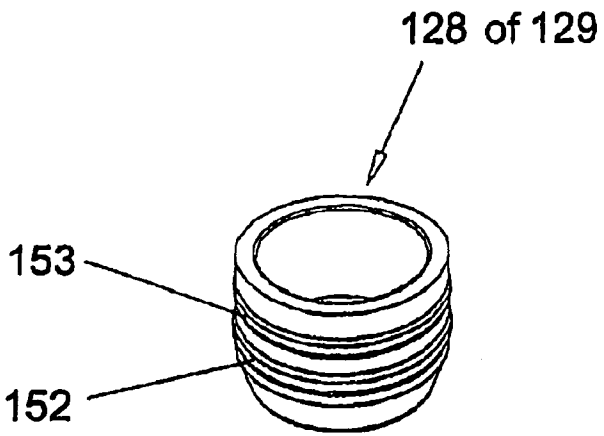
FIGS. 14 and 15 show a perspective top plan view and bottom plan view, respectively, of a closing cap.
Figure 14:
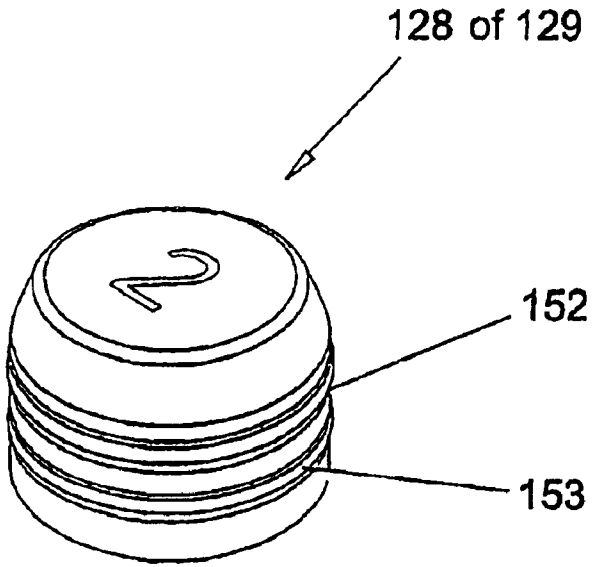

The sealing caps 128, 129 which are represented in FIGS. 14 and 15 are provided with a number of edges 152, 153 which provide for the sealing action of the sealing caps 128, 129.

The suspension means of FIGS. 16 and 17 are designed as a flexible bracket 143 which can be bent around the rim of a toilet bowl. Onto the bracket 143, the earlier-mentioned hooking element 144 is provided. Further, a rib 164 is provided on the bracket for centering the bracket 143 relative to the bottle 102. FIG. 17 clearly shows the nose 165 of the bracket 143 which is pushed into the holder 101. On the nose, a stop 166 is provided which limits the insertion of the nose 165 into the holder 101. With 167, a reinforcing rib is indicated which prevents the bracket 143 from bending at that point. On the other free extremity of the bracket 143, ribs 168 are provided for preventing the bracket 143 from sliding from the rim of the toilet. Furthermore, these ribs on the bracket 143 provide an embellishment.

FIG. 18 shows a bottom view of the holder 101 and FIG. 19 shows a top plan view of the holder 101. The holder 101 is provided with a circumferential edge 169 for placing the bottle 102 therein. The ascending edge 170 simplifies placement of the bottle 102. Slots 171 serve for a good outflow of water. Second slots 172 provide for a good supply of water to the liquid collecting element 173. With reference numeral 174, an opening is indicated in which the nose 165 of the flexible bracket 143 can be received. Reference numeral 175 indicates two projections with the aid of which the rod-shaped elements 126, 127 are pushed upwards when placing the bottle 102. When an excess pressure threatens to arise in the bottle 102, for instance as a result of a temperature rise in the toilet space, the active liquid will be pressed out via the outflow openings 108, 109. To prevent all this liquid from ending up directly on the liquid collecting element 173, the holder 101 is provided with a buffer chamber 176, 177 at each outflow opening 108, 109. In these buffers chambers 176, 177, each time, four projections 178 are disposed which push the sealing cap 128, 129 from the outflow openings 108, 109 when placing the bottle 102 onto the holder 101. Also clearly visible, in FIG. 19, are bypass slots 179 via which, at an excess pressure in the bottle 102, the active liquid can flow into the buffer chamber 176, 177. Naturally, via these bypass slots 179 the active liquid also flows back into the bottle 102 when the pressure therein decreases. Primarily, for that matter, these bypass slots 179 have the function of air supply to the compartments of the bottle 102. Further, FIG. 19 clearly shows the earlier-mentioned sealing edge 156 which cooperates with the closing wall 155 of the closing cap 147. Further, around the sealing edge 156, a protective wall 180 is arranged which prevents the sealing wall 156 from being damaged when placing the bottle 102. In the bottom view of FIG. 18, clearly, three projections 181, 182 are shown which cooperate with three openings 194, 195 in the liquid collecting element 173 for keeping this liquid collecting element 173 in its place. Also, clearly, two outflow openings 183, 184 are visible via which the active liquid can reach the liquid collecting element 173. The partitions 185 serve for increasing the stability of the holder 101. Around the outflow openings 183, 184, cylindrical walls 188 are arranged which, in assembled condition of the liquid collecting element 173, have a free end face abutting against this liquid collecting element 173.

FIGS. 20 and 21 show the liquid collecting element 173 which is provided with a network of grooves 189, 190, among which radial grooves 189 extending radially from central outflow areas 192, 193. The liquid collecting element 173 is further provided with circular grooves 190 whose imaginary center coincides with the center of the outflow areas 192, 193. Also on a side facing away from the flushing water stream, the liquid collecting element 173 is provided with circular grooves 196, which is visible in FIG. 21. Via a large number of small holes 191, the top surface and the bottom surface of the liquid collecting element 173 are in communication with each other, so that active liquid can accumulate both on the top surface and on the bottom surface of the liquid collecting element 173. In FIG. 21, it is clearly visible that the circumference of the liquid collecting element 173 is bounded by a depending edge 197 which prevents active liquid present in the grooves 196 from being flushed away by flushing water upon a flushing operation. Also, two projections 198 are represented with the aid of which the liquid collecting element 173 rests against the wall of the toilet bowl. Also, a center partition 199 is shown located at the upper side of the liquid collecting element 173 and which prevents the different active liquids from mixing with each other. Clearly represented, further, are the openings 194, 195, engaged by the projections 181, 182 of the holder 101 for connecting the liquid collecting element 173 to the holder 101.

In the present exemplary embodiment of the liquid collecting element 173, the holes 191 are formed in that the grooves 196 in the bottom surface intersect the radial grooves 189 in the upper surface.

As the active liquid, upon flushing of the toilet, will not or hardly be flushed away from the side of the liquid collecting element 173 facing away from the flushing water stream, this side of the liquid collecting element 173 facing away from the flushing water stream serves as a liquid buffer for rapidly replenishing the side of the liquid collecting element 173 facing the flushing water stream with active liquid upon flushing.

It is noted that instead of the network of grooves 189, 190, the liquid collecting element can also be provided with other means for guiding active liquid thereover. For instance, these other means may comprise a brush-like structure which is arranged on opposite sides of the substantially plate-shaped liquid collecting element 173. Also, a pattern of indentations or projections arranged in a regular or irregular manner may form the means for guiding the active liquid over the liquid collecting element 173. Examples of such alternative structures are shown in FIG. 7. Here, it should be noted that due to the presence of small holes 191 in the liquid collecting elements 173, in all these embodiments of the liquid collecting element 173, the side of the liquid collecting element 173 facing away from the flushing water stream may serve as a buffer for active liquid, from which buffer the side of the liquid collecting element 173 facing the flushing water stream can be replenished after a flushing operation of the toilet, so that a large evaporation surface is obtained and a substantial amount of active substance is available for evaporation directly after the flushing operation. The advantage of a thus designed liquid collecting element 173 is that it can be manufactured in a simple manner with the aid of an injection-molding process, so that each liquid collecting element 173 has the same defined properties. When using a porous material, such as, for instance, Porex, these defined properties are not guaranteed. As a consequence, it may occur that the absorption of the active liquid from the left-hand compartment proceeds substantially more rapidly than the absorption of the active liquid from the right-hand compartment or vice versa. The means for guiding the active liquid, disposed on opposite sides of the plate-shaped element, thus form a sort of porous mass with accurately defined, reproducible absorption properties.

FIG. 22 shows a side view of the third exemplary embodiment. Clearly visible are the flexible bracket 143, the bottle 102, the holder 101, the liquid collecting element 173 and the manner in which these parts are connected to each other in assembled condition.

From FIG. 23, which shows a cross section along the line XXIII—XXIII of FIG. 22 passing through the tubular elements 123, 124, it clearly appears that the rod-shaped elements 126, 127 have been pushed upwards by the two projections 175 of the holder 101, so that the sealing heads 162 of the rod-shaped elements 126, 127 have been pushed out of the tubular elements 123, 124. In this manner, an air communication is brought about between the two compartments 103, 104 via the pressure-equalizing chamber 125 which is bounded by the sealing edge 156 of the holder 101 and closing wall 155 of the closing cap 147. What is accomplished as a result of this air communication is that the liquid levels in the two compartments 103, 104 are always equal. Even when there is a substantial difference in viscosity of the two liquids in the respective compartments 103, 104, still, as a result of the pressure-equalizing chamber 125, substantially the same liquid level is maintained.

The cross-sectional view XXIII—XXIII further shows that the sealing caps 128, 129 have been pushed out of the outflow openings 108, 109 of the closing cap 147.

FIG. 24 shows a cross-sectional view along the line XXIV—XXIV of FIG. 22, which cross section passes through the outflow openings 108, 109 of the bottle 102. The cylindrical walls 186, bounding the outflow openings 108, 109, engage the projection 178-supporting cylindrical parts 187 of the holder 101. Meanwhile, the projections 178 have pushed the sealing caps 128, 129 from the outflow openings 108, 109 of the closing cap 147. The cylindrical sealing edge 156 sealingly cooperates with the cylindrical sealing wall 155 of the closing cap 147. FIG. 24 further shows the manner in which the liquid collecting element 173 is fitted on the projections 181, 182. Further, the vertical wall parts of the buffer chambers 176, 177 are clearly visible. It is also clearly shown that the free end faces of the cylindrical walls 188 abut against the liquid collecting element 173. As already indicated hereinabove, the cylindrical parts 187 comprise bypass slots 179 via which liquid can flow from the bottle 102, in the event of an excess pressure in this bottle 102, to the buffer chambers 176, 177. These bypass slots 179 are each clearly visible in the cross-sectional view along the line XVI—XVI of FIG. 24, which cross-sectional view is represented in FIG. 26. These bypass slots 179 specifically serve for the supply of air to the compartments when the reduced pressure in these compartments becomes too high.

The cross-sectional view of FIG. 25 clearly shows the manner in which the suspension means 143 is attached to the holder 101 and cooperates with the bottle 102. Also, the position of the liquid collecting element 173 in the holder 101 is clearly visible.

FIG. 26 clarifies in what manner the liquid collecting element 173 is positioned in the holder 101. Also, the buffer chambers 176, 177 are clearly visible, having therein the bypass slots 179. FIG. 26 also shows the sealing edge 156 of the holder 101 and the sealing wall 155 of the closing cap 147. The pressure-equalizing chamber 125 and the projections 175 present therein for pushing the closing elements 126, 127 upwards are clearly visible in FIG. 26. The latter also holds for the second slots 172 which allow the passage of the flushing water to the liquid collecting element 173. Also shown are the slots 171 in the holder 101 for allowing flushing water with active liquid to pass from the holder 101.

FIG. 27 shows a cross-sectional view along the line XXVII—XXVII of FIG. 24, visualizing the three projections 181, 182 of the holder 101 with the aid of which the liquid collecting element 173 is connected to the holder 101.

The invention is not limited to the exemplary embodiments described with reference to the drawings here, but encompasses all sorts of modifications thereof, naturally in as far as they fall within the scope of protection of the following claims. Thus, the liquid collecting element defined as a plate can also be of bent design, or the liquid collecting element may be formed by two or more plates mutually including an angle. Of importance is that both a side of the liquid collecting element situated in the flushing water path and a side not situated directly in the flushing water path are provided with liquid collecting means which are mutually connected. The word plate is therefore not intended in the sense of flat plate, but in the sense of object having two sides.

What is claimed is:

1. A device with a toilet care action, provided with a reservoir having at least one compartment for an active liquid, a liquid collecting element manufactured from a non-porous material which, during use, is constantly or periodically in communication with the contents of the at least one compartment, and provided with fastening means for fastening the device to the rim of a toilet bowl in such a manner that, in an operative condition of the device, the liquid collecting element is located in a path of toilet flushing water, the liquid collecting element having a side facing the flushing water stream and a side facing away from the flushing water stream, the side facing the flushing water stream being provided with liquid collecting means, wherein the side of the liquid collecting element facing away from the flushing water stream is also provided with liquid collecting means which are in communication with the liquid collecting means of the side facing the flushing water stream via channels provided in the liquid collecting element.

2. A device according to claim 1, wherein the liquid collecting element is designed as a plate which is provided with a screening to at least partly screen the liquid collecting means of the side facing away from the flushing water stream during use of the flushing water.

3. A device according to claim 2, wherein the edge of the plate is provided with a downwardly directed wall which, starting from the side of the plate facing the flushing water stream, extends in the direction of and slightly beyond the side of the plate facing away from the flushing water stream.

4. A device according to claim 3, wherein the liquid collecting means of the side facing away from the flushing water stream comprise capillary grooves.

5. A device according to claim 4, wherein the grooves of the side facing away from the flushing water stream extend concentrically along substantially curved, in particular circular and/or elliptical paths in the plate.

6. A device according to claim 5, wherein the grooves are substantially equidistantly spaced apart, in particular at a mutual distance in the range of 0.1–4 mm, more particularly at a distance in the range of 1–3 mm.

7. A device according to claim 6, wherein said channels have a diameter in the range of 0.05–0.5 mm.

8. A device according to claim 7, wherein the liquid collecting means of the side facing the flushing water stream comprise capillary grooves.

9. A device according to claim 8, the at least one compartment is provided with an outflow opening which in an operative condition of the device is in communication with a respective liquid receiving area situated on a side of the liquid collecting element facing the flushing water stream, while the capillary grooves of the side facing the flushing water stream are connected with the receiving area.

10. A device according to claim 9, wherein the grooves of the side facing the flushing water stream comprise a number of main grooves which are in direct communication with the receiving area, as well as a number of subgrooves which are connected with each other and/or with the main grooves.

11. A device according to claim 10, the subgrooves comprise a number of grooves which extend along substantially straight paths in said plate.

12. A device according to claim 11, wherein the sub grooves comprise a number of curved grooves which extend along curved, in particular circular and/or elliptical paths, around the respective receiving area in the plate.

13. A device according to claim 12, wherein the grooves of the side facing away from the flushing water stream extend along paths which, at least viewed in a cross section of the plate, substantially do not overlap said curved grooves of the side facing the flushing water stream.

14. A device according to claim 10, wherein the main grooves and subgrooves jointly constitute a spider web-like groove network centered substantially on the receiving areas.

15. A device according to claim 8, wherein the channels are formed in that the grooves from the side facing the flushing water stream intersect the grooves on the side facing away from the flushing water stream.

16. A device according to claim 15, wherein it is provided with a holder which comprises the fastening means and a bottle, detachably connected with the holder, including the at least one compartment.

17. A device according to claim 16, wherein the liquid collecting element is provided with positioning projections and/or walls for positioning the plate in the holder.

18. A device according to claim 17, wherein it is provided with at least two compartments for active liquid, the liquid collecting means on the liquid collecting element being separated from each other, such that, also on the liquid collecting element, the active substance from a first compartment does not mix with active substance from a second compartment.

* * * * *